US007103290B2

(12) United States Patent
Koie et al.

(10) Patent No.: US 7,103,290 B2
(45) Date of Patent: Sep. 5, 2006

(54) APPARATUS FOR FORMING IMAGE WITH AUTOMATED CORRECTION OF PROPERTY OF REGULAR IMAGE WITHOUT USING EXTRA IMAGE

(75) Inventors: Hiroshi Koie, Nagoya (JP); Masashi Ueda, Nagoya (JP); Masashi Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 88 days.

(21) Appl. No.: 11/026,061

(22) Filed: Jan. 3, 2005

(65) Prior Publication Data

US 2005/0152706 A1 Jul. 14, 2005

(30) Foreign Application Priority Data

Jan. 8, 2004 (JP) ..... 2004-003243

(51) Int. Cl.
*G03G 15/00* (2006.01)

(52) U.S. Cl. ..... 399/15; 399/45

(58) Field of Classification Search ..... 358/523; 399/15, 38, 39, 45, 46, 59, 60
See application file for complete search history.

(56) References Cited

U.S. PATENT DOCUMENTS 5,614,934 A 3/1997 Yoshida et al.
5,682,573 A * 10/1997 Ishikawa et al. ..... 399/46
6,081,353 A * 6/2000 Tanaka et al. ..... 358/523
6,377,758 B1 * 4/2002 OuYang et al. ..... 399/15

FOREIGN PATENT DOCUMENTS

| | | |
|---|---|---|
| JP | A 2-169272 | 6/1990 |
| JP | B2 2957813 | 7/1999 |
| JP | A 11-258872 | 9/1999 |
| JP | A 11-348350 | 12/1999 |
| JP | A 2001-209270 | 8/2001 |

* cited by examiner

*Primary Examiner*—Hoang Ngo
(74) *Attorney, Agent, or Firm*—Oliff & Berridge, PLC

(57) ABSTRACT

An apparatus for forming an image is disclosed in which an image is formed on an image-formed medium under an image formation condition; a feature of the image formed on the image-formed medium is measured to thereby obtain measurement results which are stored in a storage medium; at least one of the measurement results which conforms to image data representative of a new image to be formed is retrieved as a reference measurement-result from the storage medium; and the image formation condition for the image data representative of the new image is set based on the retrieved reference measurement-result.

31 Claims, 15 Drawing Sheets

| Year | Date | Time | Time since Power-on of Printer (MIN) | Temperature (°C) | Humidity (%) | Print Mode | Type of Paper | Tray No. | Size of Paper | Registration | Duplex | Name of Measurement Data | Development Bias (V) | | | | Number of Sheets Printed by Developers | | | | |
|---|---|---|---|---|---|---|---|---|---|---|---|---|---|---|---|---|---|---|---|---|---|
| | | | | | | | | | | | | | K | Y | M | C | K | Y | M | C | |
| 2004 | December 10 | 14:00 | 10 | 10 | 10 | Business graphics | Plain Paper | 2 | A4 | CENTER | ON | Z0000 | 500 | 500 | 500 | 500 | 0 | 0 | 0 | 0 | At shipment of printer by factory |
| 2005 | January 23 | 9:00 | 2301 | 15 | 10 | Photo | Thick Paper | 3 | B5 | CENTER | OFF | A0123 | 498 | 478 | 512 | 503 | 0 | 0 | 0 | 0 | At earliest power-on of printer |
| 2005 | February 5 | 13:03 | 1002 | 13 | 15 | Business graphics | OHP | 1 | Letter | LEFT | ON | A0205 | 487 | 497 | 487 | 478 | 31 | 25 | 25 | 25 | |
| 2005 | March 29 | 15:05 | 10329 | 18 | 30 | Text | Plain Paper | 4 | A4 | CENTER | ON | A0329 | 485 | 487 | 465 | 497 | 45 | 39 | 39 | 39 | |
| 2005 | April 23 | 19:56 | 3904 | 20 | 45 | Text | Plain Paper | 2 | A4 | CENTER | ON | A0423 | 468 | 467 | 476 | 487 | 55 | 50 | 50 | 50 | |
| 2005 | May 18 | 8:30 | 43409 | 22 | 60 | Text | Plain Paper | 2 | A4 | CENTER | OFF | A0518 | 450 | 445 | 465 | 476 | 130 | 121 | 121 | 121 | |
| 2005 | June 3 | 12:00 | 22204 | 25 | 80 | Text | Plain Paper | 1 | A4 | LEFT | ON | A0603 | 445 | 446 | 455 | 453 | 358 | 345 | 345 | 345 | |
| 2005 | July 7 | 13:10 | 22 | 28 | 80 | Text | Plain Paper | 2 | A4 | CENTER | ON | A0707 | 440 | 434 | 433 | 423 | 543 | 534 | 534 | 534 | |
| 2005 | August 15 | 7:04 | 345 | 32 | 90 | Text | Plain Paper | 2 | A4 | CENTER | OFF | A0815 | 420 | 412 | 417 | 408 | 1054 | 985 | 985 | 985 | |
| 2005 | September 10 | 23:12 | 2 | 25 | 85 | Photo | Plain Paper | 2 | A4 | CENTER | ON | A0910 | 388 | 378 | 368 | 358 | 3245 | 3021 | 3021 | 3021 | |
| 2005 | October 10 | 3:02 | 34556 | 23 | 67 | Business graphics | Plain Paper | 2 | A4 | CENTER | ON | A1010 | 369 | 379 | 383 | 374 | 4524 | 4234 | 4234 | 4234 | |
| 2005 | November 18 | 16:09 | 221 | 18 | 55 | Text | Plain Paper | 2 | A4 | CENTER | ON | A1118 | 359 | 347 | 354 | 367 | 4997 | 4532 | 4532 | 4532 | |
| 2005 | December 6 | 17:45 | 343 | 11 | 30 | Business graphics | Thick Paper | 1 | B5 | LEFT | OFF | A1206 | 354 | 334 | 332 | 343 | 6433 | 5985 | 5985 | 5985 | |
| 2006 | January 15 | 23:22 | 2200 | 13 | 10 | Text | Plain Paper | 2 | Letter | CENTER | OFF | B0115 | 343 | 344 | 341 | 340 | 8975 | 8345 | 8345 | 8345 | |
| 2006 | January 30 | 19:06 | 4453 | 14 | 12 | Text | Plain Paper | 2 | A4 | CENTER | ON | B0130 | 335 | 341 | 332 | 334 | 9346 | 8678 | 8678 | 8678 | |
| 2006 | February 4 | 3:09 | 2435 | 11 | 20 | Text | Envelope | 1 | COM-10 | LEFT | ON | B0204 | 323 | 333 | 327 | 330 | 9520 | 8765 | 8765 | 8765 | |
| 2006 | March 15 | 4:56 | 212356 | 14 | 17 | Text | Recycled Paper | 2 | A4 | CENTER | OFF | B0315 | 320 | 321 | 342 | 334 | 10004 | 9254 | 9254 | 9254 | |
| 2006 | April 15 | 8:56 | 343532 | 18 | 40 | Text | Plain Paper | 2 | A4 | CENTER | ON | B0415 | 310 | 315 | 312 | 313 | 12345 | 11050 | 11050 | 11050 | |
| 2006 | May 30 | 4:32 | 45594 | 18 | 45 | Photo | Plain Paper | 2 | A4 | CENTER | ON | B0530 | 302 | 299 | 298 | 302 | 24405 | 23005 | 23005 | 23005 | |
| 2006 | June 2 | 9:54 | 349904 | 26 | 76 | Text | Plain Paper | 2 | A4 | CENTER | ON | B0602 | 290 | 288 | 290 | 270 | 35512 | 34012 | 34012 | 34012 | |
| | ⋮ | | | | | ⋮ | | | | | ⋮ | | | | | ⋮ | | | | | ⋮ |
| 2007 | October 30 | 10:01 | 2342 | 11 | 20 | Text | Envelope | 1 | COM-10 | LEFT | ON | C0123 | 500 | 500 | 500 | 500 | 1 | 1 | 1 | 1 | Exchange of Developer |
| 2007 | November 1 | 11:02 | 3456 | 18 | 40 | Text | Plain Paper | 2 | A4 | CENTER | ON | C0354 | 498 | 488 | 490 | 494 | 4 | 4 | 4 | 4 | |
| 2007 | December 31 | 23:59 | 5949 | 15 | 23 | Text | Plain Paper | 2 | A4 | CENTER | ON | C1231 | 490 | 490 | 492 | 495 | 100 | 100 | 100 | 100 | |

FIG. 8

APPARATUS FOR FORMING IMAGE WITH AUTOMATED CORRECTION OF PROPERTY OF REGULAR IMAGE WITHOUT USING EXTRA IMAGE

This application is based on Japanese Patent Application No. 2004-003243 filed Jan. 8, 2004, the content of which is incorporated hereinto by reference.

CROSS-REFERENCE TO RELATED APPLICATIONS

Not Applicable.

BACKGROUND OF THE INVENTION

1. Field of the Invention

The present invention relates to a technique of forming an image, and more particularly to a technique of correcting the property of an image to be formed.

2. Description of the Related Art

There are each known as an apparatus for forming an image, an inkjet printer, a laser printer, etc. The laser printer is classified into a monochrome laser printer for printing a monochrome image, a color laser printer for printing a multi-color image, etc.

In general, the above color laser printer is configured, such that a photoconductor is exposed to a laser beam, to thereby form on the photoconductor an electrostatic latent image corresponding to a visible image to be eventually formed, such that toner is then attached to the formed electrostatic latent image for development thereof, and such that the developed image is transferred by way of an intermediate transfer medium onto an print sheet of paper, resulting in the formation of the visible image on the print sheet.

The printings using the above laser printer require the photoconductor to be rotated. Possible variations in speed of the photoconductor in rotation, temporal deterioration of movable components of the laser printer due to friction thereof, etc. may therefore result in unexpected variations in position of an image printed on a print sheet.

In addition, toner, which is used for development of the electrostatic latent image, is varied in ability of the toner to be attached to such as the photoconductor, due to change in the ambient environment (e.g., room temperature, humidity, etc.) and temporal deterioration of the toner itself. These may therefore result in errors in density of an image printed.

To eliminate the above potential disadvantages, a conventional laser printer is configured, such that, at the initiation stage of a printing operation of the printer, or after printings for a predetermined number of sheets of paper are completed, a predefined test pattern is formed on the photoconductor and the intermediate transfer medium, such that the density and the position of the test pattern formed are detected, and such that, based on the detection results, corrections are made to the density and the position. This is disclosed by Japanese Patent Publication No. Hei 11-258872.

BRIEF SUMMARY OF THE INVENTION

The above conventional laser printer requires the formation of such a test pattern for the correction of the density and the position. For this reason, the conventional laser printer fails to perform regular printings during the formation of such a test pattern for the correction. In addition, the conventional laser consumes an extra amount of toner and extra recording media (e.g., extra sheets of paper) for the formation of such a test pattern.

It is therefore an object of the present invention to provide a technique of forming an image in an appropriate manner without using an extra test pattern.

According to the present invention, there is provided an apparatus for forming an image, comprising:

an image-forming device that forms an image on an image-formed medium under an image formation condition, based on image data;

a measuring device that measures a feature of the image formed on the image-formed medium by the image-forming device based on the image data externally entered, to thereby obtain measurement results which are stored in a storage medium; and a setting device that retrieves from the storage medium as a reference measurement-result at least one of the measurement results which conforms to image data representative of a new image to be formed, and that sets the image formation condition for the image data representative of the new image, based on the retrieved reference measurement-result.

In the apparatus according to the present invention, the image forming device forms an image on the image-formed medium under the image formation condition, wherein the image is presented by the image data externally entered. Further, the measuring device measures the feature of the image formed on the image-formed medium, to thereby obtain measurement results. The measurement results are stored in the storage medium.

Where image data representing a new image to be formed is present, the setting device retrieves from the storage medium as a reference measurement-result at least one of the measurement results which conforms to the image data representative of the new image. The setting device may retrieve the reference measurement-result by referring to the image data representative of the new image.

Further, the setting device sets the image formation condition for the image data representative of the new image, based on the retrieved reference measurement-result.

As will be readily understood from the above, in the apparatus according to the present invention, where a user of the apparatus enters image data for making the apparatus to form an image which the user wishes to obtain as a printed matter, the image formation condition is updated based on the measurements of the feature of the image formed on the image-formed medium (e.g., a photoconductor, an intermediate transfer medium, a sheet of paper, etc.).

The apparatus according to the present invention therefore allows the image formation condition to be updated using the previous measurement results obtained through the previous regular image-formations, without requiring an extra formation of a test image, resulting in formation of an image in an appropriate manner.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities show. In the drawings:

FIG. 8 is a graphical representation of a management table established in an inner memory 50*g* and an external memory 90 both shown in FIG. 3;

DETAILED DESCRIPTION OF THE INVENTION

Figure 1:
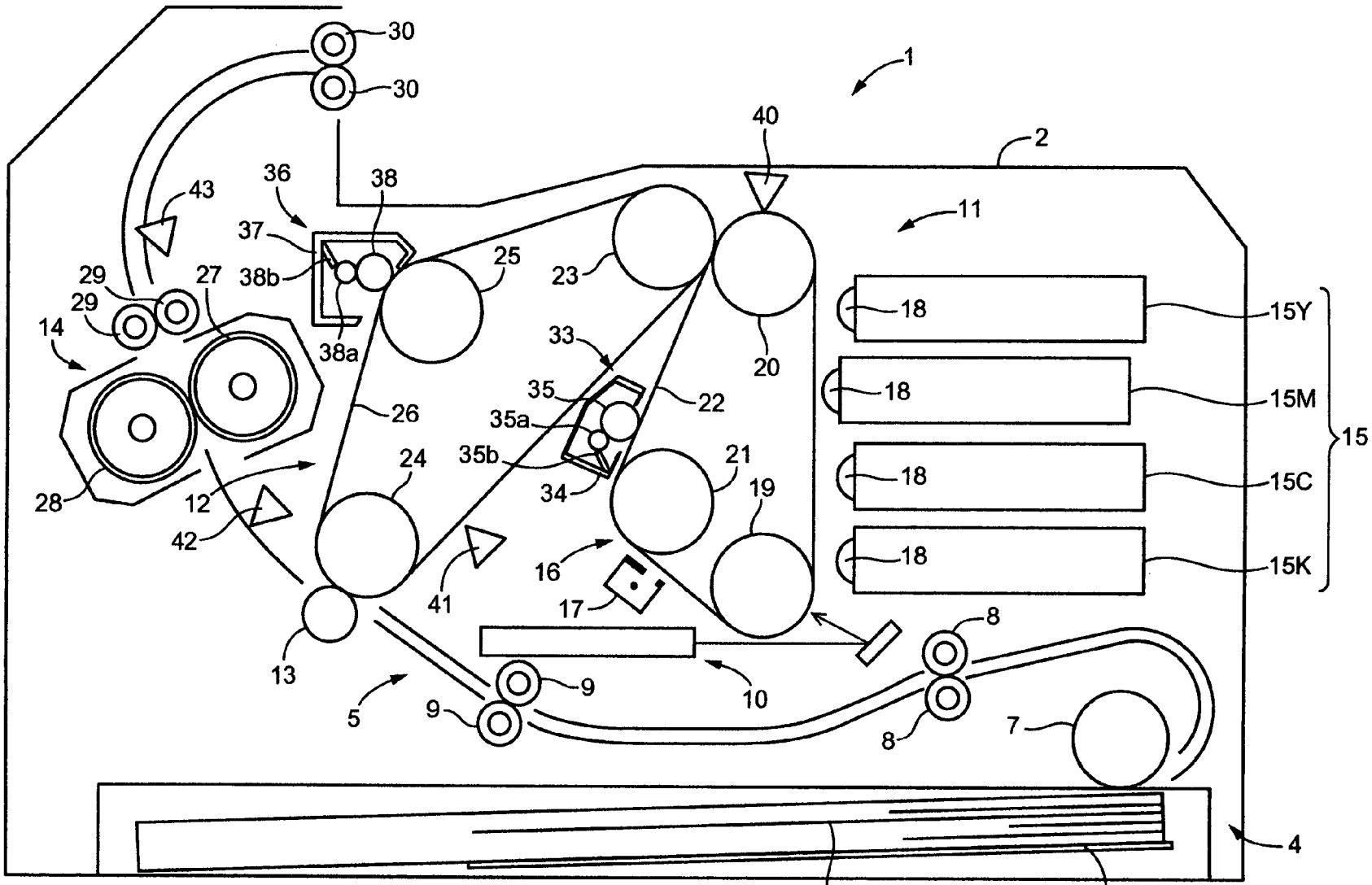
FIG. 1 is a side sectional view schematically illustrating the interior of a printer 1 according to a first embodiment of the present invention.

The object mentioned above may be achieved according to any one of the following modes of this invention.

These modes will be stated below such that these modes are sectioned and numbered, and such that these modes depend upon the other mode or modes, where appropriate. This is for a better understanding of some of a plurality of technological features and a plurality of combinations thereof disclosed in this description, and does not mean that the scope of these features and combinations is interpreted to be limited to the scope of the following modes of this invention.

That is to say, it should be interpreted that it is allowable to select the technological features which are stated in this description but which are not stated in the following modes, as the technological features of this invention.

Furthermore, stating each one of the selected modes of the invention in such a dependent form as to depend from the other mode or modes does not exclude a possibility of the technological features in a dependent-form mode to become independent of those in the corresponding depended mode or modes and to be removed therefrom. It should be interpreted that the technological features in a dependent-form mode is allowed to become independent according to the nature of the corresponding technological features, where appropriate.

(1) An apparatus for forming an image, comprising:

an image-forming device that forms an image on an image-formed medium under an image formation condition, based on image data;

a measuring device that measures a feature of the image formed on the image-formed medium by the image-forming device based on the image data externally entered, to thereby obtain measurement results which are stored in a storage medium; and a setting device that retrieves from the storage medium as a reference measurement-result at least one of the measurement results which conforms to image data representative of a new image to be formed, and that sets the image formation condition for the image data representative of the new image, based on the retrieved reference measurement-result.

In the apparatus according to the above mode (1), where a user of the apparatus enters image data for making the apparatus to form an image which the user wishes to obtain as a printed matter, the image formation condition is updated based on the feature of the image previously formed on the image-formed medium (e.g., a photoconductor, an intermediate transfer medium, a sheet of paper, etc.).

The apparatus according to the above mode (1) therefore allows the image formation condition to be updated using the previous measurement results obtained through the previous regular image-formations, without requiring extra formation of a test image, resulting in formation of an image in an appropriate manner.

(2) The apparatus according to mode (1), wherein the setting device retrieves from the storage medium as the reference measurement-result at least one of the measurement results which was obtained by the measuring device for a previous separate image that was formed by the image-forming device in a state substantially the same as a state in which the new image is to be formed by the image-forming device.

(3) The apparatus according to mode (1) or (2), wherein the setting device sets the image formation condition for the new image to be formed, based on a difference between a desired value of the new image and the retrieved reference measurement-result.

(4) The apparatus according to mode (3), wherein the measurement results are stored in the storage medium in association with respective previous values of the image formation condition, wherein the respective previous values were employed by the image-forming device for forming respective previous images from which the respective measurement results were obtained by the measuring device, the setting device calculates a correction value of a corresponding one of the previous values stored in the storage medium, based on the difference; updates content of the storage medium to reflect the calculated correction value, to thereby update a correspondence between desired values of images formed and respective previous values of the image formation condition; and determines a current value of the image formation condition according to the updated correspondence.

(5) The apparatus according to any one of modes (1) to (4), wherein the image data is commanded by a user of the apparatus to form an image arbitrarily demanded by the user.

(6) The apparatus according to any one of modes (1) to (5), wherein a new measurement result, once obtained by the measuring device, is stored in the storage medium with replacement of a separate measurement result previously stored therein with the new measurement result.

(7) The apparatus according to any one of modes (1) to (5), wherein a new measurement result, once obtained by the measuring device, is stored in the storage medium with separate measurement results previously stored therein, without replacement of any one of the separate measurement results with the new measurement result.

(8) The apparatus according to any one of modes (1) to (5), wherein the measuring device obtains, together with the measurement result, an environmental parameter defining environment in which an image is formed by the image-forming device, wherein the measurement result is stored in the storage medium in association with the obtained environmental parameter, the setting device retrieves from the storage medium, prior to formation of the new image, as the reference measurement-result, at least one of the measurement results which is associated with the environmental parameter substantially coincident with the environmental parameter which was obtained by the measuring device for the new image, and sets the image formation condition based on the retrieved reference measurement-result.

In the apparatus according to the above mode (8), there is measured an environmental parameter defining environment in which an image is formed by the image-forming device, together with the feature of the image formed, and the measurement results that relate to the feature of the image formed are stored in the storage medium in association with the measured environmental parameter.

Further, there is retrieved as the reference measurement-result from the storage medium, at least one of the measurement results which is associated with the environmental parameter in conformity in value with, which is to say, for example, identical in value or substantially the most approximate in value to, the environmental parameter which was obtained by the measuring device for the new image.

Still Further, using the retrieved reference measurement-result, the image formation condition is corrected.

(9) The apparatus according to any one of modes (1) to (8), wherein the image data and the measurement result each comprise at least position-related information which relates to an image-formed position at which an image is formed on the image-formed medium, the image formation condition comprises a position-related condition which relates to a position at which an image is to be formed on the image-formed medium, the setting device comprises a position-related-condition setting subsystem that sets the position-related condition, based on the position-related information of the image data and the position-related information of the measurement result.

In the apparatus according to the above mode (9), where the image data includes the position-related information and where the measurement result includes the position-related information, the position-related condition of the image formation condition is set based on the position-related information of the image data and the position-related information of the measurement result.

The apparatus according to the above mode (9) therefore allows the position-related condition to be appropriately set, resulting in achievement of the formation of an image at an appropriate or desired position.

(10) The apparatus according to mode (9), wherein the image data comprises at least user-commanded position data specifying an image-formed position commanded by a user of the apparatus, the measurement result comprises at least measured-position data representative of an image-formed position measured by the measuring device, the position-related-condition setting subsystem sets the position-related condition based on a relationship between the user-commanded position data and the measured-position data.

(11) The apparatus according to mode (9) or (10), wherein the measuring device measures the image-formed position on a per primary color basis.

In the apparatus according to the above mode (11), where a multi-color image is formed, a position at which the image is formed is measured on a per primary color basis. The apparatus therefore allows the position-related condition to be set on a per primary color basis, contributing to the formation of a multi-color image with less color shift.

(12) The apparatus according to any one of modes (9) to (11), wherein the image comprises a line segment, the position-related-condition setting subsystem employs information specifying a position at which the line segment is formed on the image-formed medium, to thereby set the position-related condition.

In general, the occurrence of a shift in position of an image formed including a line segment would result in: a shift in position of the line segment; a distortion at a part of the line segment eventually causing a shift in position of the instant part; or a shift in angle of the line segment eventually causing a shift in position of the entire or a part of the line segment.

In view of the above findings, the apparatus according to the above mode (12) is configured, where an image includes a line segment, the information specifying a position at which the line segment is formed on the image-formed medium is utilized to set the position-related condition.

The employment of the information specifying the position of the line segment allows an easier and more accurate capture of the position of an image formed, compared with employment of information specifying the position of a separate figure formed, such as a curved segment.

The apparatus according to the above mode (12) therefore allows the position-related condition to be set more easily and more accurately.

The "line segment" set forth in the above mode (12) may be defined as a border between adjacent areas different in color on the image-formed medium. More preferably, the "line segment" is formed as a linear figure with width, namely, a line image, or as a straight line formed as an outline or border of a figure with area.

(13) The apparatus according to any one of modes (9) to (12), wherein the position-related-condition setting subsystem sets the position-related condition each the image forming device forms an image or a series of images.

The apparatus according to the above mode (13), in which the position-related condition is set each an image or a series of images is formed, accordingly allows, even if a previous cycle of an image formation was performed with a shift in position of an image formed, the subsequent cycle of an image formation to be performed with a reduced or eliminated shift in position of an image formed.

(14) The apparatus according to any one of modes (1) to (13), wherein the image data and the measurement result each comprise at least picture-property-related information which relates to a picture property defined to include at least one of density, hue, gloss, and haze of the image, the image formation condition comprises a picture-property-related condition which relates to the picture property of an image is to be formed on the image-formed medium, the setting device comprises a picture-property-related-condition setting subsystem that sets the picture-property-related condition, based on the picture-property-related information of the image data and the picture-property-related information of the measurement result.

In the apparatus according to the above mode (14), where the image data includes the picture-property-related information and where the measurement result includes the picture-property-related information, the picture-property-related condition of the image formation condition is set based on the picture-property-related information of the image data and the picture-property-related information of the measurement result. The "picture property" is defined to include at least one of density, hue, gloss, and haze of the image.

The apparatus according to the above mode (14) therefore allows the picture-property-related condition to be appropriately set, resulting in achievement of the formation of an image with an appropriate or desired picture-property.

(15) The apparatus according to mode (14), wherein the image data comprises at least user-commanded picture-property data specifying the picture property commanded by the user, the measurement result comprises at least measurement picture-property data representative of the picture property measured by the measuring device, the picture-property-related-condition setting subsystem sets the picture-property-related condition based on a relationship between the user-commanded picture-property data and the measurement picture-property data.

(16) The apparatus according to mode (14) or (15), wherein the measuring device measures the picture property on a per primary color basis.

In the apparatus according to the above mode (16), where a multi-color image is formed, the above-defined picture property is measured on a per primary color basis. The apparatus therefore allows the picture-property-related condition to be set on a per primary color basis, contributing to an appropriate formation of a multi-color image.

(17) The apparatus according to any one of modes (14) to (16), wherein the measuring device measures the picture property per a measuring area with a predetermined size on the image-formed medium.

The concentration of image-forming material (e.g., developing material, toner) within the measuring area is useful in setting the picture-property-related condition of the image formation condition in an appropriate manner.

In addition, the above concentration may be obtained from the relationship between the size of the measuring area and the measurement result of the picture property (e.g., density, hue, gloss, or haze).

In light of the above findings, the apparatus according to the above mode (17) may be operated, such that the picture-property-related condition is set based on the measurement result of the picture property obtained using the measuring device.

(18) The apparatus according to any one of modes (14) to (17), wherein the picture-property-related-condition setting subsystem sets the picture-property-related condition, each the image forming device forms an image or a series of images.

The apparatus according to the above mode (18), in which the picture-property-related condition is set each an image or a series of images is formed, accordingly allows, even if a previous cycle of an image formation was performed with an error in the picture property of an image formed, the subsequent cycle of an image formation to be performed with a reduced or eliminated error in the picture property of an image formed.

(19) The apparatus according to any one of modes (14) to (18), wherein the picture-property-related-condition setting subsystem performs successive settings for a set value of the picture-property-related condition, and makes a change to the set value within a range allowing the set value to be changed per one cycle of the setting.

In the apparatus according to the above mode (19), the set value of the picture-property-related condition is changed within the allowable range per cycle of the setting of the set value.

The allowable range may be defined to be within the range of the set value which can cause a user of the apparatus to notice the difference in density, hue, gloss, or haze between a previously-formed and a subsequently-formed image, at the user's glance thereat. In this case, during the formation of successive images, there is no chance of the user to notice a considerable difference in density, hue, gloss, or haze between a previously-formed and a subsequently-formed image.

(20) The apparatus according to any one of modes (14) to (19), wherein the picture-property-related-condition setting subsystem is operative, each the image forming device executes one cycle of a job for forming an image or a series of images.

The apparatus according to the above mode (20) prevents the above-defined picture property, such as density, hue, gloss, and haze of each image formed, from being distinctly varied during one cycle of the job for the image formation.

(21) The apparatus according to any one of modes (14) to (20), wherein the image forming device employs colorant for formation of an image, the apparatus further comprising a correcting subsystem that corrects the picture-property-related condition by a predetermined correction amount in response to replacement of the colorant.

The apparatus according to the above mode (21) allows, provided that the predetermined correction amount is preset so as to be in conformity with a new fresh colorant, an image to be formed with density, hue, gloss, or haze being in conformity with the new fresh colorant, since a time immediately after the initiation of the use of the new fresh colorant.

(22) The apparatus according to any one of modes (1) to (20), wherein the image forming device employs colorant for formation of an image, the apparatus further comprising a first delivery subsystem that delivers as the image data first test-data representative of a predetermined first test-image to the image forming device in response to replacement of the colorant, wherein the measuring device measures the feature of the image formed by the image forming device based on the delivered first test-data, to thereby obtain the measurement result.

The apparatus according to the above mode (22) allows the image formation condition to be set, using the first test-image, so as to reflect the characteristics of the actual and each individual new-fresh-colorant.

(23) The apparatus according to mode (21) or (22), further comprising a removable container for containing the colorant.

The apparatus according to the above mode (23) allows an easy replacement of the colorant. Further, the apparatus allows an easy determination as to whether or not the apparatus will be or has been replenished with a new fresh colorant, provided that the container is monitored as to whether at least one of a removal of the container from the apparatus, and an attachment of the container to the apparatus for replenishment of a new colorant.

(24) The apparatus according to any one of modes (21) to (23), wherein the colorant comprises toner or ink.

(25) The apparatus according to any one of modes (1) to (24), further comprising a second delivery subsystem that delivers to the image forming device, upon satisfaction of a predetermined condition in a state that makes the measuring device incapable to measure a predetermined feature of the image, second test-data representative of a second test-image predefined to incorporate the predetermined feature, wherein the measuring device measures the feature of the image formed by the image forming device based on the delivered second test-data, to thereby obtain the measurement result.

The apparatus according to the above mode (25) allows the image formation condition to be appropriately set using the second test-image, even where the image represented by the image data externally entered does not include the feature required for setting the image formation condition.

The "predetermined condition" may be defined with respect to the length of an elapsed time, the number at which a particular event happens repeatedly, etc. One example of the number is how many an image formation has been performed on the image-formed medium.

(26) The apparatus according to mode (25), further comprising a control subsystem that permits the second delivery subsystem to operate upon demand for formation of the second test-image.

The apparatus according to the above mode (26) prevents the image-forming device from forming the second test-image uselessly.

(27) The apparatus according to mode (25) or (26), wherein the predetermined condition comprises a condition to be satisfied upon elapse of a predetermined period of time.

(28) The apparatus according to any one of modes (1) to (27), wherein the image-formed medium is formed as a recoding medium.

The apparatus according to the above mode (28) allows an image to be formed on the recording medium (e.g., a sheet of paper or transparent film) in an appropriate manner.

(29) A storage medium set forth in any one of modes (1) to (28).

(30) The storage medium according to mode (29), wherein the storage medium is removably attached to the apparatus.

A mere attachment to the apparatus for forming an image, of the storage medium according to the above mode (30), which is of a removable type, allows the apparatus to set the image formation condition in an appropriate manner.

The storage medium according to the above mode (30) may be shared for use with a plurality of apparatuses for forming images. In this case, after the same storage medium has been used in a first one of the apparatuses, the storage medium may be used for a second one of the apparatuses, such that the image formation condition is set so as to reflect the measurement results which were obtained in the first one and which have been stored in the same storage medium, resulting in an appropriate setting of the image formation condition.

(31) A method of forming an image, comprising:

forming an image on an image-formed medium under an image formation condition, based on image data;

measuring a feature of the image formed on the image-formed medium based on the image data externally entered, to thereby obtain measurement results;

storing the obtained measurement results in a storage medium;

retrieving from that storage medium as a reference measurement-result at least one of the measurement results which conforms to image data representative of a new image to be formed; and setting the image formation condition for the image data representative of the new image, based on the retrieved reference measurement-result.

In the method according to the above mode (31), where image data for forming an image which a user wishes to obtain as a printed matter is externally entered, the image formation condition is updated based on the feature of the image previously formed on the image-formed medium (e.g., a photoconductor, an intermediate transfer medium, a sheet of paper, etc.).

The method according to the above mode (31) therefore allows the image formation condition to be updated using the previous measurement results obtained through the previous regular image-formations, without requiring extra formation of a test image, resulting in formation of an image in an appropriate manner.

Several presently preferred embodiments of the invention will be described in detail by reference to the drawings in which like numerals are used to indicate like elements throughout.

Referring now to FIG. 1, the interior of a printer 1 according to a first embodiment of the present invention is schematically illustrated in side cross-sectional view.

As shown in FIG. 1, the printer 1 includes a body casing 2. The printer 1 includes, within the body casing 2, a feeder section 4, and an image forming section 5 for forming an image on a sheet 3 of paper which functions as a recording medium. The feeder section 4 feeds a sheet 3 of paper to the image forming section 5, and then the image forming section 5 forms an image on the fed sheet 3.

The feeder section 4 includes: a feeder tray 6; a feeder roller 7; a pair of transport rollers 8, 8; and a pair of registration rollers 9, 9. The feeder section 4 is configured, such that individual sheets 3 of paper are retrieved by means of the feeder roller 7, sheet by sheet, from the feeder tray 6 in which these sheets 3 of paper are stacked, and such that the retrieved sheet 3 is then fed toward the image forming section 5 by means of the pair of transport rollers 8, 8 and the pair of registration rollers 9, 9.

The image forming section 5 includes: a scanning device 10; a processing device 11; a transfer device 12; and a fusing device 14. The image forming section 5 is configured, such that the processing device 11 develops an electrostatic latent image formed by means of the scanning device 10, such that the developed electrostatic latent image (hereinafter, referred to also as "developer image") is transferred onto a sheet 3 of paper by means of the transfer device 12, and such that the transferred developer image is fused onto the sheet 3 of paper by means of the fusing device 14.

The scanning device 10 includes: a laser emitting section; a polygon mirror; a plurality of lenses; and a plurality of reflecting mirrors, although are not shown in FIG. 1. The scanning device 10 is configured, such that a laser beam emitted from the laser emitting section is deflected at the polygon mirror, the plurality of lenses, and the plurality of reflecting mirrors, and such that a photoconductive belt 22 of the processing device 11 is scanned with the deflected laser beam. The photoconductive drum 22 will be described below in more detail.

The processing device 11 includes a developer unit 15, a photoconductive or exposure unit 16 containing the photoconductive belt 22, and a charger 17. The processing device 11 is so configured as to cause the charger 17 to charge the photoconductive belt 22 of the photoconductive unit 16. The charged photoconductive belt 22 is exposed to the laser beam, to thereby form the electrostatic latent image on the photoconductive belt 22 which is subsequently developed by means of the developer unit 15.

The photoconductive unit 16 includes: a first photoconductive roller 19; a second photoconductive roller 20; a third photoconductive roller 21; and the photoconductive belt 22. The photoconductive belt 22 is wound around the first, second, and third photoconductive rollers 19, 20, 21 to provide a rotational drive for the photoconductive belt 22 around the first, second, and third photoconductive rollers 19, 20, and 21.

More specifically, the first and second photoconductive rollers 19, 20 are disposed to face to each other in an up and down direction, as shown in FIG. 1. The first photoconductive roller 19, which is positioned below the second photoconductive roller 20, is disposed, in the vicinity of the third photoconductive roller 21, away upward toward the left from the first photoconductive roller 19, as shown in FIG. 1. The photoconductive belt 22 is in the form of an endless belt made up of synthetic resin such as polyethylene terephthalate (PET). A coating of aluminum is evaporated over the surface layer of the synthetic resin. The surface of the photoconductive belt 22 is covered with an organic photoconductive layer.

The developer unit 15 includes: a developer 15Y for supplying a yellow toner; a developer 15M for supplying a magenta toner; a developer roller 15C for supplying a cyan toner; and a developer 15K for supplying a black toner. Each of the developers 15Y, 15M, 15C, and 15K includes a developer roller 18, and further includes a thickness-regulating blade, a supply roller, and a toner storage, although are not shown in FIG. 1. The developers 15Y, 15M, 15C, and 15K are each configured, such that the supply roller supplies toner stored in the toner storage to the developer roller 18, and such that the supplied toner is subsequently carried on the developer roller 18 so as to form a thin layer with a predetermined thickness by means of the thickness-regulating blade.

In the present embodiment, the developers 15Y, 15M, 15C, and 15K are each configured to utilize a positively charged, non-magnetic mono-component, and polymeric toner. As is well-known, the toner storages of the developers 15Y, 15M, 15C, and 15K each accommodate a toner container (not shown) which is detachably attached to the body of the corresponding one of the developers 15Y, 15M, 15C, and 15K.

The developers 15Y, 15M, 15C, and 15K are disposed away rightward from the photoconductive unit 16 as shown in FIG. 1, and in parallel to each other adjacent to in an up and down direction, as shown in FIG. 1, with adjacent ones of the developers 15Y, 15M, 15C, and 15K being spaced at a predetermined distance. Once a switching mechanism 86 which will be described later (see FIG. 2) selects one of the developers 15Y, 15M, 15C, and 15K, the selected one of the developers 15Y, 15M, 15C, and 15K is moved in the horizontal direction, as shown in FIG. 1, whereby the developer roller 18 of the selected one of the developers 15Y, 15M, 15C, and 15K is selectively moved nearer to or away from the surface of the photoconductive belt 22.

The charger 17 is of the scorotron type for positive charging, which induces a corona discharge at a charging wire made up of a material such as tungsten. The charger 17, which is disposed in the vicinity of the third photoconductive roller 21 therebelow, positively charges the surface of the photoconductive belt 22 in the vicinity of the charger 17.

The processing device 11 further includes an OPC cleaner 33 which is disposed in the vicinity of and away upward toward the left from the third photoconductive roller 21, as shown in FIG. 1. The OPC cleaner 33 is configured to remove residual toner remaining on the surface of the photoconductive belt 22 even after a developer image has been transferred onto an intermediate transfer belt 26 of the transfer device 12.

The OPC cleaner 33 contains a box 34 accommodating a first cleaning roller 35, a second cleaning roller 35*a*, and a cleaning blade 35*b*. The aforementioned residual toner, upon moved onto the second cleaning roller 35*a* via the first cleaning roller 35, is scraped off from the second cleaning roller 35*a* and collected by means of the cleaning blade 35*b*.

The box 34 is shaped as a rectangular box having an opening opposing to the photoconductive belt 22. The box 34 is configured to allow the first cleaning roller 35 to project through the opening toward the photoconductive belt 22, and the collected toner in the above manner to be stored within the box 34.

The first cleaning roller 35 is made up of a resilient material such as silicone rubber. A driving mechanism 84 described later (see FIG. 2) allows the first cleaning roller 35 to selectively move nearer to or away from the surface of the photoconductive belt 22. The second cleaning roller 35*a* formed of metal is disposed in contact with the first cleaning roller 35. The cleaning blade 35*b* in the form of a thin plate-like blade is disposed in contact at the top edge thereof with the second cleaning roller 35*a*.

The transfer device 12 includes: a first transfer roller 23; a second transfer roller 24; a third transfer roller 25; and the intermediate transfer belt 26. The intermediate transfer belt 26 is wound around the first, second, and third transfer rollers 23, 24, 25 to provide a rotational drive for the intermediate transfer belt 26 around the first, second, and third transfer rollers 23, 24, 25.

More specifically, the first transfer roller 23 is so disposed as to contact, via the intermediate transfer belt 26 and the photoconductive belt 22, with the second photoconductive roller 20 of the photoconductive unit 16. The second and third transfer rollers 24, 25 are disposed away leftward from the first photoconductive roller 23 as shown in FIG. 1, facing to each other in an up and down direction, as shown in FIG. 1. The intermediate transfer belt 26 is in the form of an endless belt made up of conductive resin, such as polycarbonate and polyimide in which conductive particles such as carbon particles have been dispersed.

The transfer device 12 includes a transfer roller 13 which is disposed in the vicinity of and below the second transfer roller 24. The transfer device 12 in operation causes a sheet 3 which has been delivered to between the second transfer roller 24 and the transfer roller 13, to pass through therebetween, to thereby transfer a developer image developed on the intermediate transfer belt 26 onto the sheet 3. A driving mechanism 82 described later (see FIG. 2) allows the transfer roller 13 to selectively move nearer to or away from the second transfer roller 24.

The transfer device 12 further includes an ITB cleaner 36 which is disposed in the vicinity of and away leftward from the third transfer roller 25, as shown in FIG. 1. The ITB cleaner 36 is provided for removing residual toner remaining on the surface of the intermediate transfer belt 26 even after a developer image has been transferred onto a sheet 3 of paper.

The ITB cleaner 36 accommodates a box 37 containing a first cleaning roller 38, a second cleaning roller 38*a*, and a cleaning blade 38*b*. The aforementioned residual toner remaining on the intermediate transfer belt 26, upon moved onto the second cleaning roller 38*a* via the first cleaning roller 38, is scraped off from the second cleaning roller 38*a* and collected by means of the cleaning blade 38*b*.

As shown in FIG. 1, the box 37 is in the form of a rectangular box-like shape having an opening opposing to the intermediate transfer belt 26. The box 37 is configured to allow the first cleaning roller 38 to project through the opening toward the intermediate transfer belt 26, and the collected toner in the above manner is to be stored within the box 37.

The first cleaning roller 38 is made up of a resilient material such as silicone rubber. A driving mechanism 83 described later (see FIG. 2) allows the first cleaning roller 38 to selectively move nearer to or away from the surface of the intermediate transfer belt 26. The second cleaning roller 38*a* formed of metal is disposed in contact with the first cleaning roller 38. The cleaning blade 38*b* in the form of a thin plate-like blade is disposed in contact at the top edge thereof with the second cleaning roller 38*a*.

As shown in FIG. 1, the fusing device 14 includes: a heat roller 27; a pressing roller 28; a pair of transport rollers 29, 29; and a pair of exit rollers 30, 30. The fusing device 14 is configured, such that after a developer-image transferred onto a sheet 3 of paper has been heat-fused thereto by means of the heat roller 27, the pair of transport rollers 29, 29 and the pair of the exit rollers 30, 30 allow the sheet 3 of paper to exit from the body casing 2. More specifically, the heat roller 27 and the pressing roller 28 disposed in contact with each other are so configured as to cause a sheet 3 of paper which has been delivered to between the heat roller 27 and the pressing roller 28, to pass through therebetween, to thereby heat-fuse a developer image onto the sheet 3 of paper. The heat roller 27 containing therein a halogen lamp as a heat source is formed of an inner layer made up of metal, and an outer layer made up of silicone rubber.

As shown in FIG. 1, the printer 1 further includes density sensors 40, 41, 42, and 43. The density sensor 40 is disposed in the vicinity of and above the second photoconductive roller 20, as shown in FIG. 1. The density sensor 41 is provided between the first transfer roller 23 and the second transfer roller 24. The density sensor 42 is provided between the second transfer roller 24 and the heat roller 27. The density sensor 43 is provided between the transport roller 29 and the exit roller 30. The density sensors 40, 41, 42, and 43 are each configured to measure the density of a developer image on a per primary color basis.

In the present embodiment, each of the density sensors 40, 41, 42, and 43 is configured to be the so-called reflection-type density sensor which includes: a light source for emitting infrared or visible light; a lens for converging light emitted from the light source at an object; and a phototransistor for receiving light reflected from the object. The phototransistor is an example of a photosensor which outputs a signal representing the amount of light incident thereto upon reflected from the object.

Each of the density sensors 40, 41, 42, and 43 is configured to measure, based on the outputted signal from the corresponding phototransistor, the density of an object per a predetermined measuring area (an area of a given size) thereon.

In the present embodiment, the density of an image is expressed by the ratio of the number of pixels covered with toners (pixels colored with toners) to the number of all the pixels located within the predetermined measuring area of the object. The density of an image is measured on a per primary color basis in multiple levels.

The density sensors 40, 41, 42, and 43 are provided for measuring the densities of the photoconductive belt 22, the intermediate transfer belt 26, and the sheet 3 of paper, each functioning as the above object, at the respective fixed measuring positions. Each of the measuring position is one of both lateral ends of a corresponding one of the photoconductive belt 22, the intermediate transfer belt 26, and the sheet 3 of paper (see FIG. 7).

Figure 2:
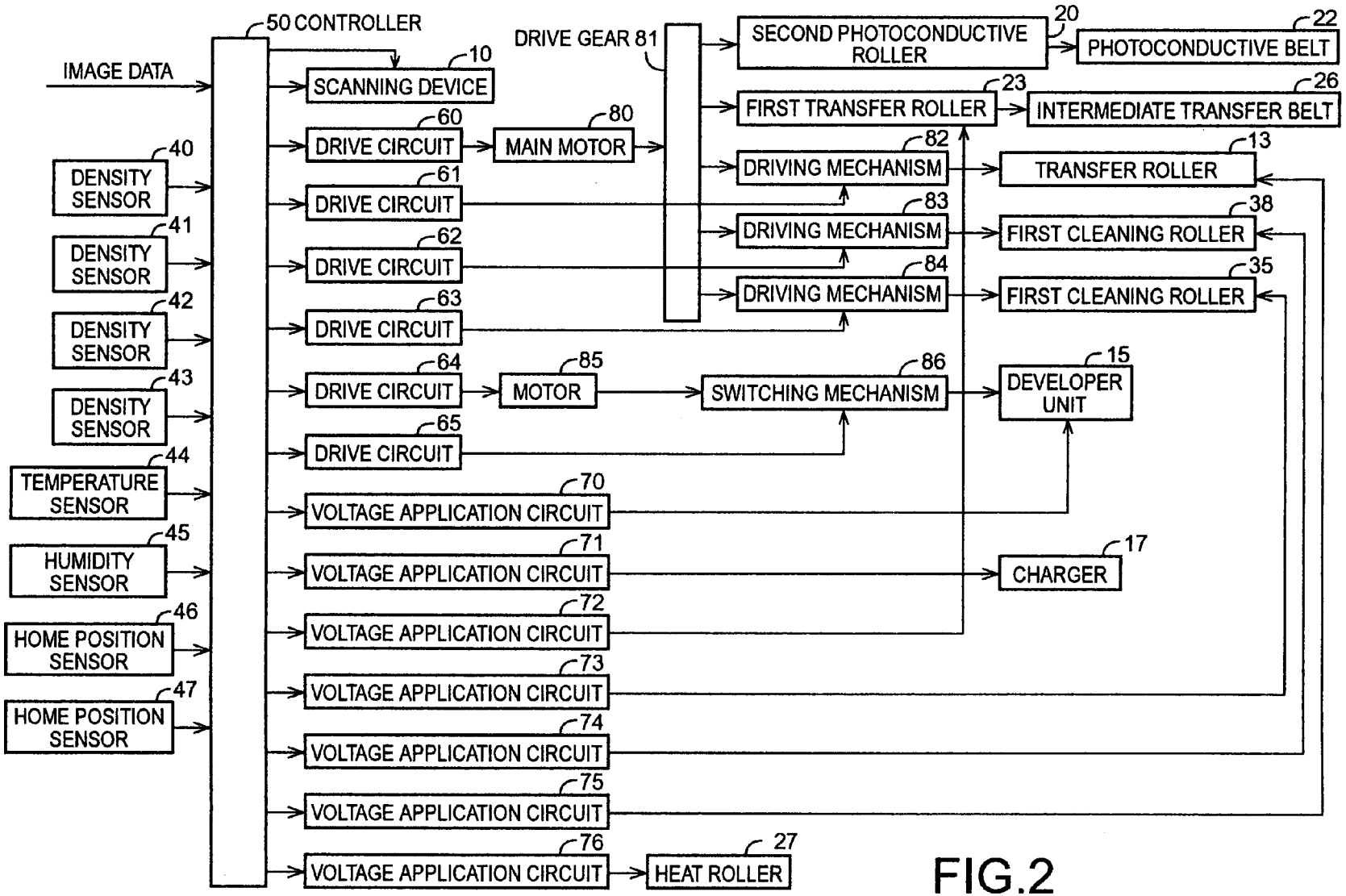
FIG. 2 is a block diagram schematically illustrating a control system of the printer 1 shown in FIG. 1.

In FIG. 2, the configuration of a control system of the printer 1 is depicted in block diagram. As shown in FIG. 2, the printer 1 includes a controller 50 which totally controls various component devices of the printer 1. To the controller 50, the various component devices mounted within the printer 1 are electrically coupled, to thereby organize the control system of the printer 1.

More specifically, the controller 50 is electrically coupled to the aforementioned density sensors 40, 41, 42, and 43; a temperature sensor 44 for measuring the interior temperature of the body casing 2; a humidity sensor 45 for measuring the interior humidity of the body casing 2; a home position sensor 46 for detecting the home position of the photoconductive belt 22; and a home position sensor 47 for detecting the home position of the intermediate transfer belt 26. The controller 50 receives measurement and detection results from those sensors 40–47.

The controller 50 is further electrically coupled to the scanning device 10 so as to output signals for causing the aforementioned laser emitting section of the scanning device 10 to emit a laser beam, and for activating a motor to drive the aforementioned polygon mirror rotationally.

The controller 50 is further electrically coupled to drive circuits 60, 61, 62, 63, 64, and 65. The controller 50, through those drive circuits 60–65, controls driving or activation of the various component devices which are connected to the drive circuits 60–65.

More specifically, to the drive circuit 60, there is electrically coupled a main motor 80 which is mounted within the printer 1 as a rotary driving-power source of and in common to the second photoconductive roller 20, the first transfer roller 23, the transfer roller 13, and the first cleaning rollers 35 and 38. The controller 50 drives the main motor 80, via the drive circuit 60, to thereby impart rotational movements to the second photoconductive roller 20, the first transfer roller 23, the transfer roller 13, and the first cleaning rollers 35 and 38.

The main motor 80 is mechanically coupled via a drive gear 81 employing gear trains, to the second photoconductive roller 20, the first transfer roller 23, the transfer roller 13, and the first cleaning rollers 35 and 38, for adjustment of the rotational movements of those rollers.

To the drive circuit 61, there is coupled the driving mechanism 82 which transmits to the transfer roller 13 the driving power transmitted from the main motor 80 through the drive gear 81, and which brings the transfer roller 13 into contact with the second transfer roller 24. The controller 50 activates the driving mechanism 82 via the drive circuit 61, thereby allowing the transfer roller 13 to rotate and to be brought into contact with the second transfer roller 24.

To the drive circuit 62, there is coupled the driving mechanism 83 which transmits to the first cleaning roller 38 of the ITB cleaner 36 the driving power transmitted from the main motor 80 through the drive gear 81, and which brings the cleaning roller 38 into contact with the surface of the intermediate transfer belt 26. The controller 50 activates the driving mechanism 83 via the drive circuit 62, thereby allowing the first cleaning roller 38 to rotate and to be brought into contact with the surface of the intermediate transfer belt 26.

To the drive circuit 63, there is coupled the driving mechanism 84 which transmits to the first cleaning roller 35 of the OPC cleaner 33 the driving power transmitted from the main motor 80 through the drive gear 81, and which brings the first cleaning roller 35 into contact with the surface of the photoconductive belt 22. The controller 50 activates the driving mechanism 84 via the drive circuit 63, thereby allowing the first cleaning roller 35 to rotate and to be brought into contact with the surface of the photoconductive belt 22.

To the drive circuit 64, there is electrically coupled a motor 85 which is mounted within the printer 1 as a driving power source for moving a selected one of the developers 15Y, 15M, 15C, and 15K closer to the photoconductive belt 22. The controller 50 drives the motor 85 via the drive circuit 64, to thereby impart power to the developer unit 15 to move a selected one of the developers 15Y, 15M, 15C, and 15K closer to the photoconductive belt 22.

To the drive circuit 65, there is electrically coupled the switching mechanism 86 for switching a destination (either one of the developers 15Y, 15M, 15C, and 15K) to which a driving power of the motor 85 is transmitted. The controller 50 activates the switching mechanism 86 via the drive circuit 65, to thereby transmit the driving power of the motor 85 to one of the developers 15Y, 15M, 15C, and 15K which is selected to be moved closer to the photoconductive belt 22, resulting in the movement of the selected one closer to the photoconductive belt 22.

The controller 50, which is electrically coupled to voltage application circuits 70, 71, 72, 73, 74, 75, and 76, applies voltages to various component devices connected to the voltage application circuits 70–76, therethrough.

More specifically, to the voltage application circuit 70, there are electrically coupled the developers 15Y, 15M, 15C, and 15K. The controller 50 applies voltage (bias voltage) to the respective developers 15Y, 15M, 15C, and 15K via the voltage application circuit 70, to thereby attach toner carried on the developer roller 18 to the photoconductive belt 22.

To the voltage application circuit 71, there is electrically coupled the charger 17. The controller 50 applies voltage to the charger 17 via the voltage application circuit 71, to thereby charge the photoconductive belt 22.

To the voltage application circuit 72, there is electrically coupled the first transfer roller 23. The controller 50 applies voltage (bias voltage) to the first transfer roller 23 via the voltage application circuit 72, to thereby charge the intermediate transfer belt 26, resulting in movement of the toner from the photoconductive belt 22 to the intermediate transfer belt 26 and in adhesion thereto.

To the voltage application circuit 73, there is electrically coupled the first cleaning roller 35 of the OPC cleaner 33. The controller 50 applies voltage (bias voltage) to the first cleaning roller 35 via the voltage application circuit 73, to thereby charge the first cleaning roller 35, resulting in movement of the toner remaining on the photoconductive belt 22 to the first cleaning roller 35 and in adhesion thereto.

To the voltage application circuit 74, there is electrically coupled the first cleaning roller 38 of the ITB cleaner 36. The controller 50 applies voltage (bias voltage) to the first cleaning roller 38 via the voltage application circuit 74, to thereby charge the first cleaning roller 38, resulting in movement of the toner remaining on the intermediate transfer belt 26 to the first cleaning roller 38 and in adhesion thereto.

To the voltage application circuit 75, there is electrically coupled the transfer roller 13. The controller 50 applies voltage (bias voltage) to the transfer roller 13 via the voltage application circuit 75, to thereby charge a sheet 3 of paper, resulting in transfer of toner from the intermediate transfer belt 26 to the sheet 3.

To the voltage application circuit 76, there is electrically coupled the heat roller 27. The controller 50 applies voltage to the heat roller 27 via the voltage application circuit 76, to thereby heat the heat roller 27.

Described as to the total operation of the printer 1, the controller 50, upon charging the photoconductive belt 22, sequentially forms electrostatic latent images onto the photoconductive belt 22 on a per primary color basis, based on an incoming image data, and subsequently develops the electrostatic latent images for the respective primary colors by respectively driving the developers 15Y, 15M, 15C, and 15K in sequence.

In the printer 1, further, the controller 50, upon charging the intermediate transfer belt 26, sequentially transfers the developed images onto the intermediate transfer belt 26, and thereafter transfers the developed images from the intermediate transfer belt 26 onto a sheet 3 of paper at the same time, by driving the transfer roller 13 previously charged. The sheet 3 onto which the developed images have been transferred is subsequently heated by means of the heat roller 27 so that the developed images are heat-fused onto the sheet 3. Thus, the printer 1 is configured as to be a color laser printer embodying a four-pass color printing process or the so-called four-cycle type.

Figure 3:
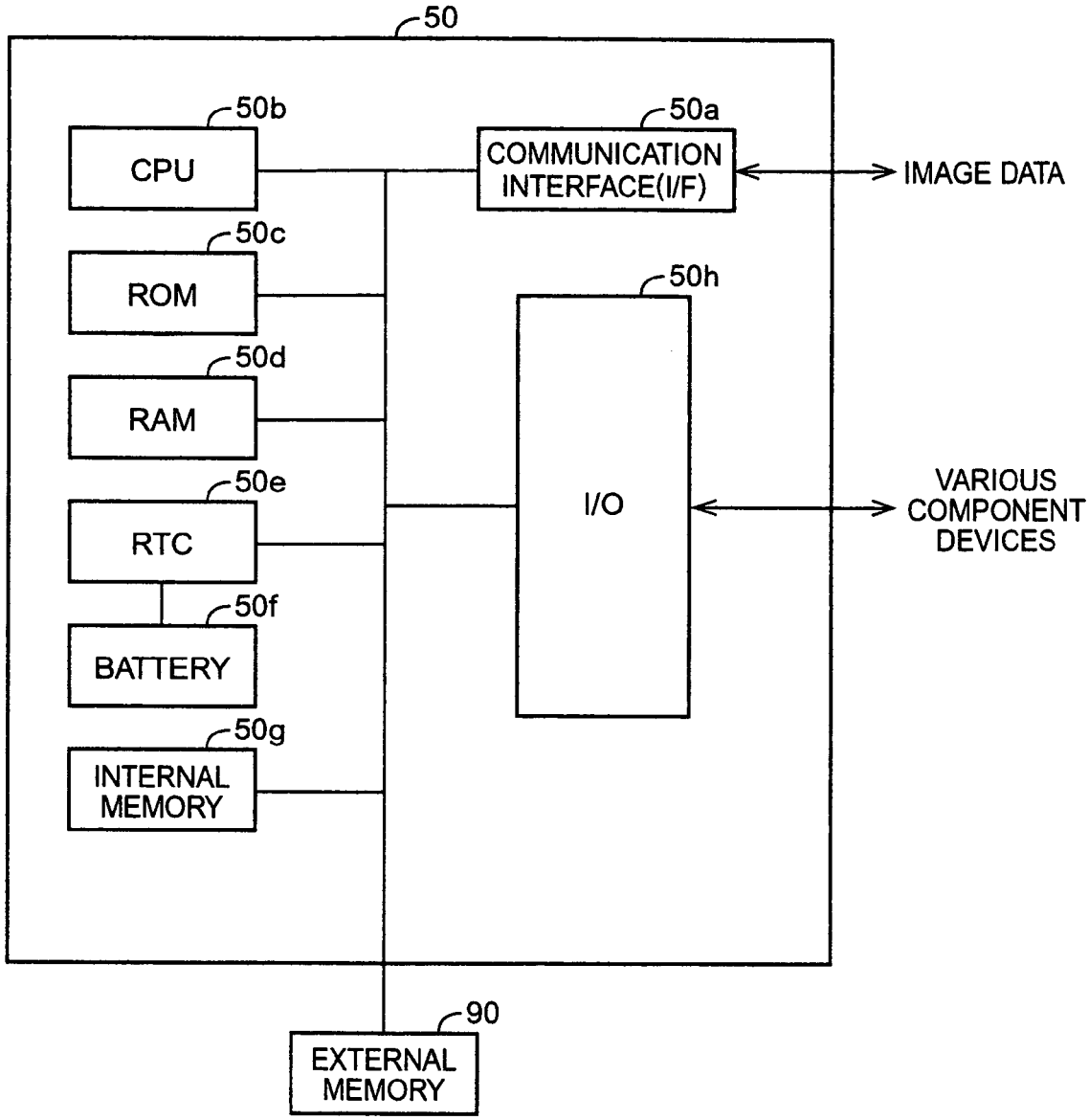
FIG. 3 is a block diagram schematically illustrating a controller 50 shown in FIG. 2.

With reference to FIG. 3, the configuration and the operation of the controller 50 will be described in more detail.

As schematically illustrated in block diagram in FIG. 3, the controller 50 includes a communication interface (hereinafter, abbreviated as "communication I/F") 50*a* which receives image data from outside. The controller 50 further includes: a CPU 50*b* which executes various processes to be performed by the controller 50; a ROM 50*c* which stores therein programs and data to be executed by the CPU 50*b*; and a RAM 50*d* which temporarily stores therein data for the execution of the various processes by the CPU 50*b*.

The controller 50 further includes: a real time clock (hereinafter, abbreviated as "RTC") 50*e*; an internal memory 50*g* which is comprised of a non-volatile memory device (such as a flush memory); and an I/O 50*h* connecting the CPU 50*b* and the aforementioned various component devices coupled to the controller 50.

The communication I/F 50*a*, the CPU 50*b*, the ROM 50*c*, the RAM 50*d*, the RTC 50*e*, the internal memory 50*g*, and the I/O 50*h*, all of which are set forth above, are connected to each other via a bus line. The RTC 50*e* is connected to a battery 50*f* which is configured to be charged with an electric power supplied to the printer 1 so as to be kept as a timer even after the printer 1 is powered down.

The CPU 50*b*, the ROM 50*c*, the RAM 50*d*, and the bus line connecting them constitute a computer in the controller 50.

As shown in FIG. 3, to the controller 50, there is further electrically coupled an external memory 90 containing a non-volatile memory device (such as a flush memory, for example). The external memory 90 is removably mounted to the printer 1.

Figure 4:
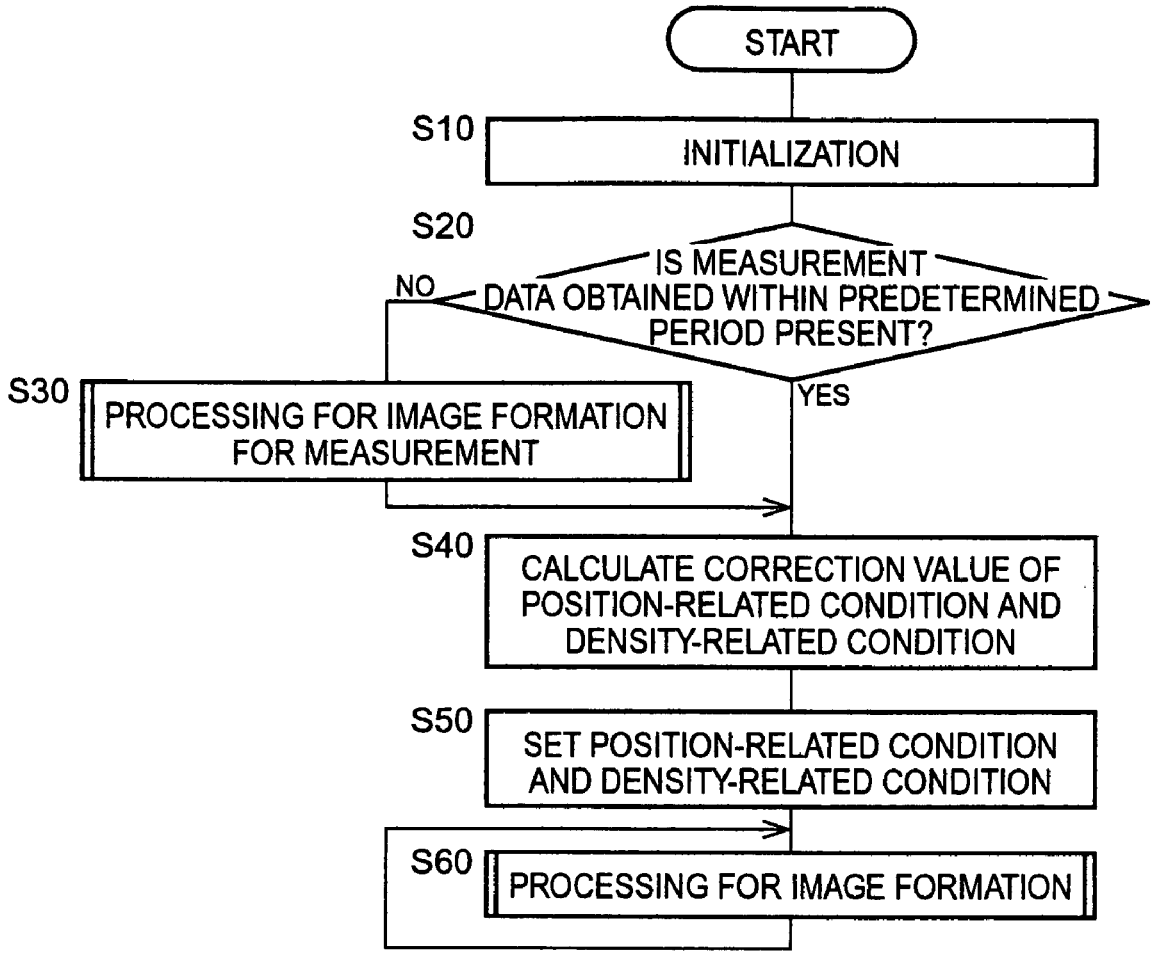
FIG. 4 is a flow chart schematically illustrating an initiation control program to be executed by a CPU 50*b* shown in FIG. 3.
Figure 5:
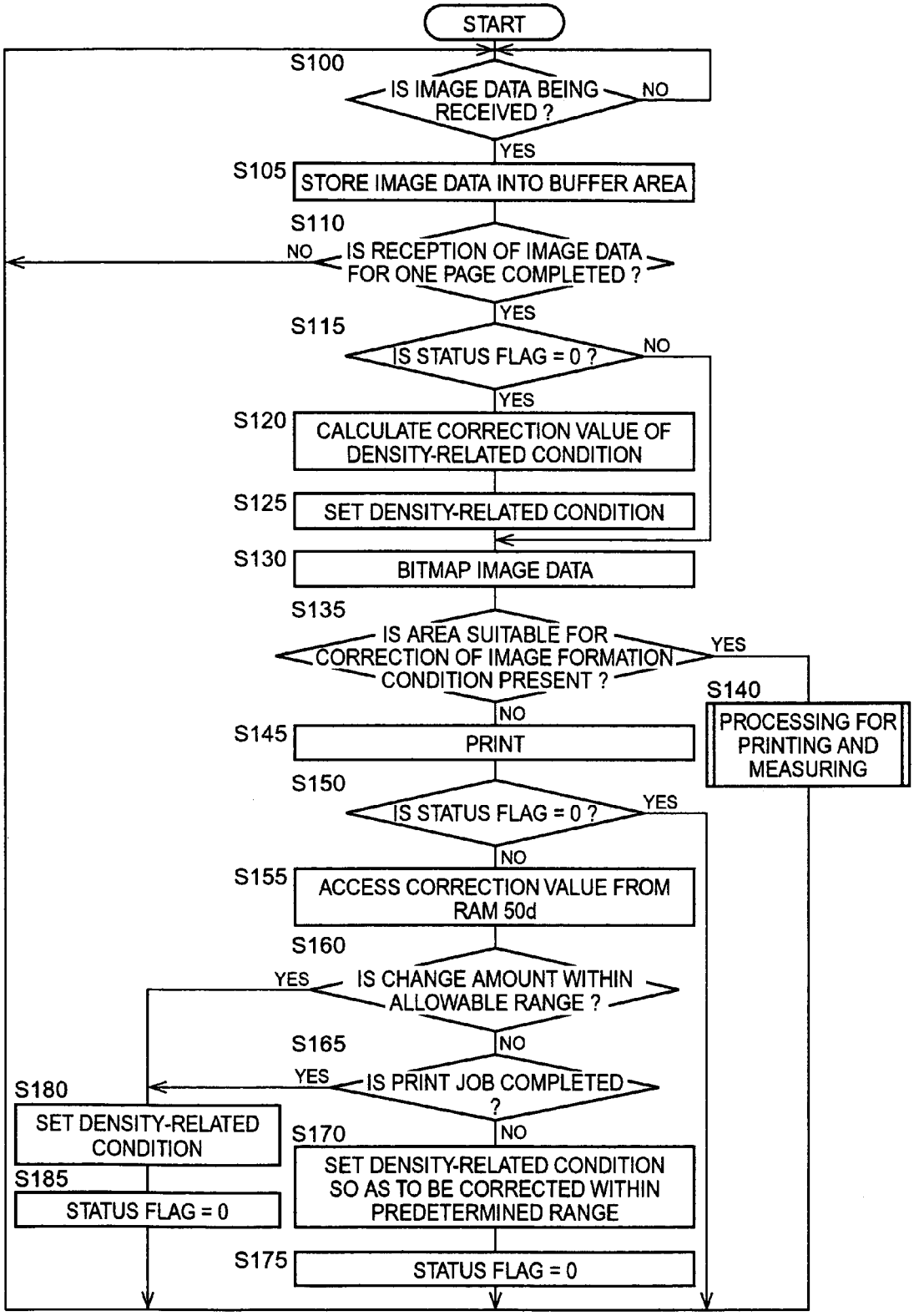
FIG. 5 is a flow chart schematically illustrating a program for processing for image formation.
Figure 6:
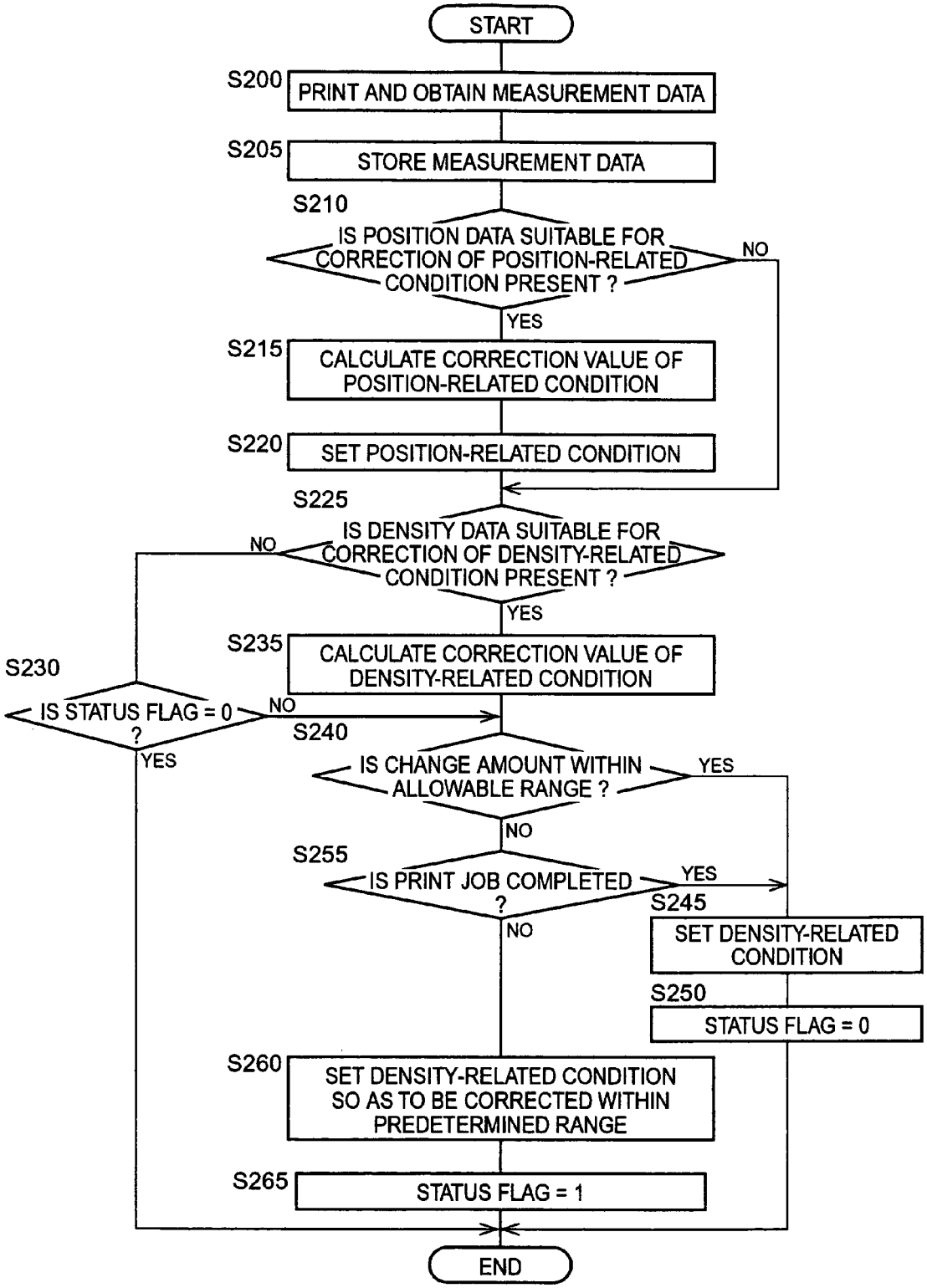
FIG. 6 is a flow chart schematically illustrating a program for processing for printing and measuring.

With reference to FIGS. 4–6, various programs for processing or control to be executed by the computer including the CPU 50*b* will be described in more detail hereunder.

Figure 12:
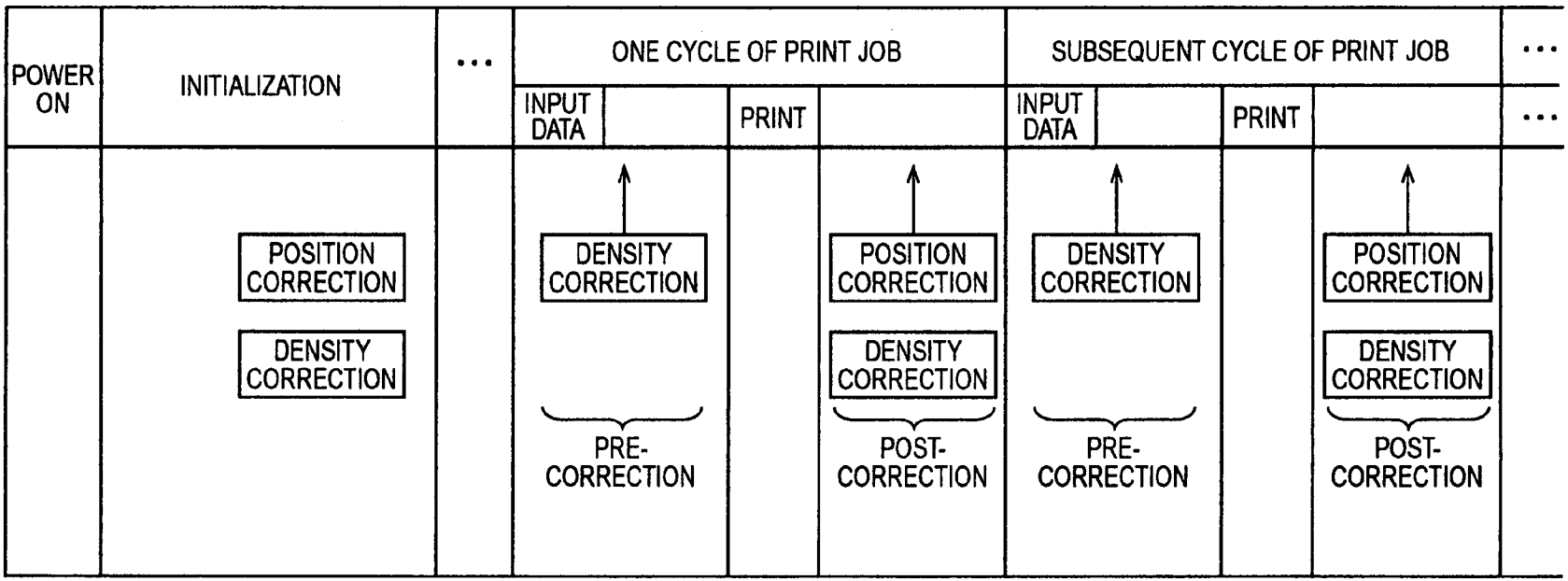
FIG. 12 is a graphical representation for explaining an approach of correcting image formation conditions by the controller 50 shown in FIG. 2.

In the present embodiment, as schematically illustrated in FIG. 12, the image formation conditions are corrected or calibrated, if necessary. The image formation conditions are set by the printer 1, according to user-commanded conditions commanded by the user with respect to conditions or states in which an image is to be printed on a sheet 3 of paper, to thereby print an image under the user-commanded conditions.

The user-commanded conditions include a density condition relating to the print density of an image to be printed, and a position condition relating to the print position of an image to be printed. The density condition relates to the density of a halftone image printed by the dither method, a toner concentration within a solid image, etc. The position condition relates to the position of a printing start end of an image on a sheet 3 of paper, for example.

Accordingly, the image formation conditions include a density-related condition relating to the print density and a position-related condition relating to the print position. The density-related condition consists of such as a development bias, an electric current to be applied in the transfer of an image, and a temperature in the heat fusing. On the other hand, the position-related condition consist of such as a control signal which is received at the aforementioned laser emitting device to control the position of a printing start end of an image on a sheet 3.

In FIG. 12, the "density correction" denotes the correction of the density-related condition, while the "position correction" denotes the correction of the position-related condition, wherein the density-related and the position-related condition belong to the image formation conditions. In the present embodiment, both of the "density correction" and the "position correction" are performed at an initialization stage of the printer 1.

In the present embodiment, a pre-correction and a post-correction are performed for each cycle of a print job. The pre-correction is defined as a correction performed prior to an actual print during each cycle of a print job to optimize the printings for the each cycle of print job. On the other hand, the post-correction is defined as a correction performed, upon completion of an actual print during each cycle of a print job, in preparation for the subsequent printings to optimize these printings.

More specifically, the pre-correction includes the aforementioned density correction which is performed during each cycle of a print job, after image data indicative of an image to be formed is received and before an actual print starts on a sheet 3 of paper. On the other hand, the post-correction includes the aforementioned position correction and the density correction both of which are performed during each cycle of a print job after completion of an actual print.

In FIG. 4, an initiation control program to be executed by the computer is schematically illustrated in flow chart. The initiation control program is activated upon power on of the printer 1.

As shown in FIG. 4, the initiation control program begins with a step S10 where the various component devices controlled by the controller 50 are initialized, resulting in the initialization of the image formation conditions of the printer 1.

In the present embodiment, there is provided a limitation of an amount (relative value) by which at least one condition of the image formation conditions is allowed to be changed per each cycle of the correction of the image formation conditions, although will be described in more detail later.

The limitation is significant especially in the correction of the density-related condition (the aforementioned development bias, for example) of the image formation conditions. The limitation prevents the print density from being changed during a series of printings rapidly enough to cause the user to notice the change in print density on the sheet 3 of paper.

To this end, in the present embodiment, there is provided to a register area of the CPU 50*b* a status flag which indicates as to whether there exceeds an allowable range per each cycle of the correction, an amount by which at least one condition of the image formation conditions is calculated to be changed per each cycle of the correction of the image formation conditions. The status flag is initialized in the step S10, as will be described later.

The amount (relative value) of change in at least one condition of the image formation conditions, which is hereinafter referred to as "calculated change amount," indicates the difference between the current absolute value of the at least one condition of the image formation conditions, and an absolute value to which the instant condition is calculated to be corrected. The current absolute value is one that will be used or that was used, both during the current cycle of print job. The absolute value is hereinafter referred to as "calculated correction value."

The calculated correction value represents an absolute value of the at least one condition of the image formation conditions which is optimum for achieving the desired level of the density of the image to be printed on the sheet 3 of paper.

Where the calculated change amount falls within the allowable range, the corresponding condition of the image formation conditions is permitted to be actually corrected so as to completely reflect the calculated change amount. In this case, the calculated change amount coincides with the amount by which the instant condition is actually corrected. The latter amount is hereinafter referred to as "correction amount."

On the other hand, where the calculated change amount exceeds the allowable range, the correction is allowed to be made in a manner that a portion of the calculated change amount within the allowable range is reflected in the corresponding condition of the image formation conditions, while a portion of the calculated change amount which exceeds the allowable range is not reflected in the instant condition. In this case, the calculated change amount and the actual correction amount of the instant condition do not coincide with each other, while a portion of the calculated change amount within the allowable range coincides with the actual correction amount.

It is defined that, the status flag represents zero "0" to indicate that the calculated change amount of the corresponding condition of the image formation conditions falls within the allowable range, while the status flag represents one "1" to indicate that the calculated change amount of the instant condition exceeds the allowable range. In the step of S10, the status flag is set to represent "0," initially indicating that, the change amount of the instant condition falls within the allowable range.

The above step S10 is followed by a step S20 where the internal memory 50g and/or the external memory 90 are accessed, and where a determination is made as to whether measurement data indicative of measurement results has been stored in the internal memory 50g and/or external memory 90 within a predetermined storage period of time (one week, for example).

Although will be described in more detail with reference to FIG. 8, a management table is established in the internal memory 50g and/or the external memory 90. The management table is arranged such that the followings are associated with each other, per each cycle of print job:

(a) environmental parameters including: such as the date and the time of the day that the measurement was performed and that the measurement results were obtained and stored; the temperature and the humidity within the body casing 2 at the measurement; the print mode employed at the measurement; and the type of a sheet 3 of paper printed at the measurement;

(b) the image formation conditions set at the measurement;

(c) the user-commanded conditions entered at the measurement; including the density condition and the position condition;

(d) the measurement data representative of the above measurement results of the print density and the print position; and (e) the information on the consumables used in the printer 1.

In the step S20, a determination is made, by referring to the management table, as to whether only such old measurement data that has been stored over the predetermined storage period is present.

Described more particularly with reference to FIG. 8, the followings are entered for storage into the management table as the aforementioned environmental parameters per each cycle of print job:

the date that the each cycle of print job was performed and the time of day that the each cycle of print job was initiated;

the period of time elapsed after the printer 1 was powered on and before the each cycle of print job was initiated;

the temperature and the humidity within the printer 1;

the print mode;

the type of the printed sheet 3 of paper;

the number of the tray selected and employed for feeding the sheet 3 of paper;

the size of the printed sheet 3 of paper;

the position at which the registration was performed for transporting the sheet 3 of paper and for printing;

the identification of a selected one of single-sided and double-sided prints;

the name of measurement data;

the development bias per each primary color;

the number of sheets 3 which were printed by means of the developers 15Y,15M,15C, and 15K, per each primary color, etc.

The name of the measurement data is defined, for example, as a file name automatically assigned to a file automatically generated for storing within the printer 1 the measurement data upon obtained.

In association with the assigned file name, the followings are together stored in the printer 1:

(a) the image formation conditions set at the measurement of the print density and the print position;

(b) the user-commanded conditions including the density condition and the position condition entered by the user at the above measurement;

(c) the measurement data including position data indicative of the measured position of an image formed on a recording medium (i.e., the print position, in the present embodiment), density data indicative of the measured density of an image formed on a recording medium (i.e., the print density, in the present embodiment).

Based on the above, in the present embodiment, although will be described in more detail later with reference to FIG. 5, once the user enters the user-commanded conditions for the current cycle of print job after implementation of the initialization step, the record of at least one of the previous cycles of print jobs which was executed under conditions having the best analogy with the user-commanded conditions presently-entered by the user is retrieved through search from the management table.

A capture of the measurements of the print position and density of the image on the sheet 3 printed during the above-described analogous previous cycle of print job would make it possible to predict, prior to execution of the current cycle of print job, an error occuring between the present user-commannded conditions, and the print position and density to be achevied after the current cycle of print job is exectued under the same image-formation-conditions as those actually employed during the analogous previous cycle of print job.

With this in mind, modification of the image formation conditions to be originally assigned to the user-commanded conditions entered by the user, prior to execution of the current cycle of print job, by making allowances for the predicted error, would allow the later actual execution of the current cycle of print job under conditions adequately close to the user-commanded conditions entered by the user. This is the processing for the aformentioned pre-correction.

Referring back to FIG. 4, the processing for performing the initialization step will be described in more detail. If the measurement data which has been stored within the predetermined storage period is present, the determination of the step S20 becomes affirmative "YES," a step S40 is immediately implemented based on the stored measurement data, without implementation of a step S30 described later.

On the other hand, if only such old measurement data that has been stored over the predetermined storage period is present, then the determination of the step S20 becomes negative "NO," and the computer proceeds to the step S30.

In the step S30, a test patch or a test pattern for measurement is printed, and the suitable measurement is then performed using the test patch, in a manner known by those skilled in the art, thereby to update the existing measurement data in the aforementioned management table. This is an image formation processing for measurement.

In the above image formation processing for measurement, an image for measurement or test, which is already prepared so as to be suitable for measuring the position and density of a formed image per each primary color, is formed on the photoconductive belt 22, the intermediate transfer belt 26, and the sheet 3 of paper in sequence. The test image is used to measure the position and the density of an image formed. The measurements of the position and the density of an image formed are performed by means of at least corresponding one of the density sensors 40, 41, 42, and 43.

Figure 9:
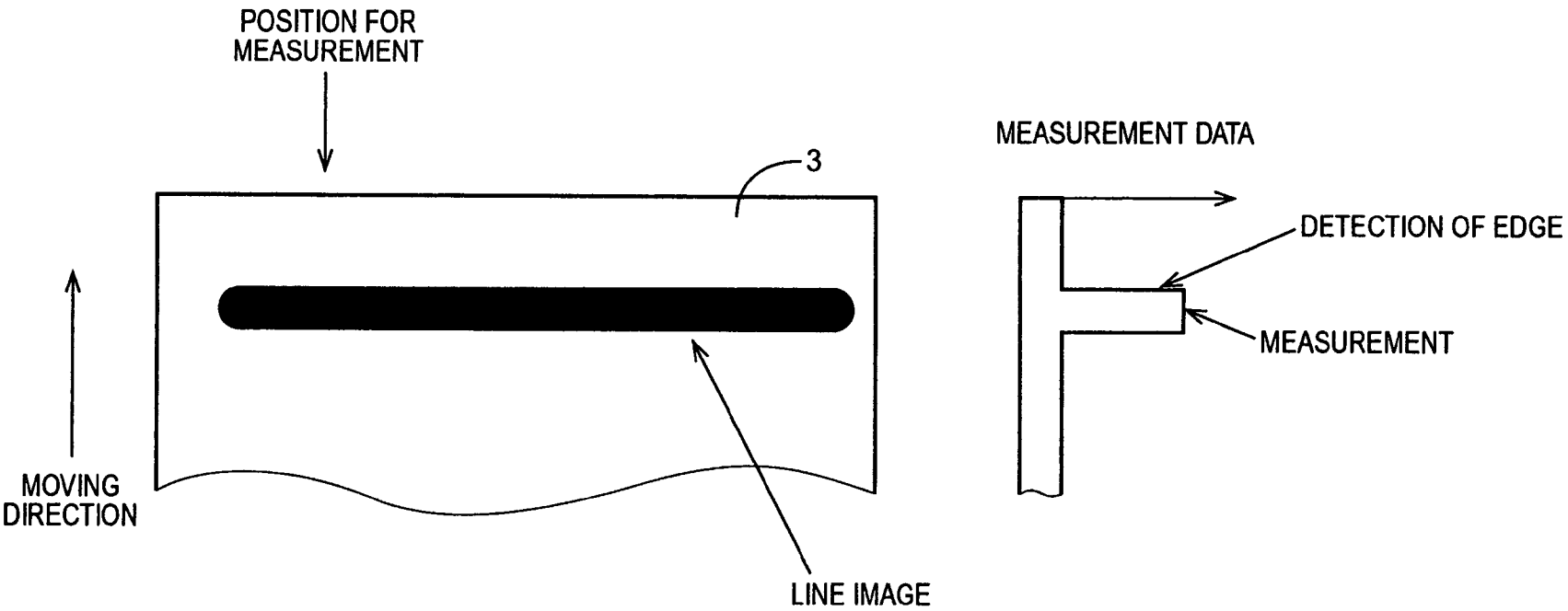
FIG. 9 schematically illustrates in view and graph an approach of measuring the position of a particular image by the controller 50 shown in FIG. 2.

More specifically, as illustrated in top view and graph in FIG. 9, a predefined line image extending in a line intersecting the moving direction of the sheet 3 of paper is formed as a first test image on the sheet 3 of paper. The longitudinal position of a selected one of the leading and trailing edges of the formed line image is measured by means of the density sensor 43. For this purpose, the density sensor 43 is utilized to detect a position at which the density is rapidly changed as the sheet 3 is fed in the longitudinal direction thereof, as the longitudinal position of the selected edge of the sheet 3. Based on the measurement results, the position of the formed line image is measured. The detection of the image-formed position may be performed by means of the density senor 41. In this case, the density sensor 41 measures the position of an image formed on the intermediate transfer belt 26.

Figure 10:
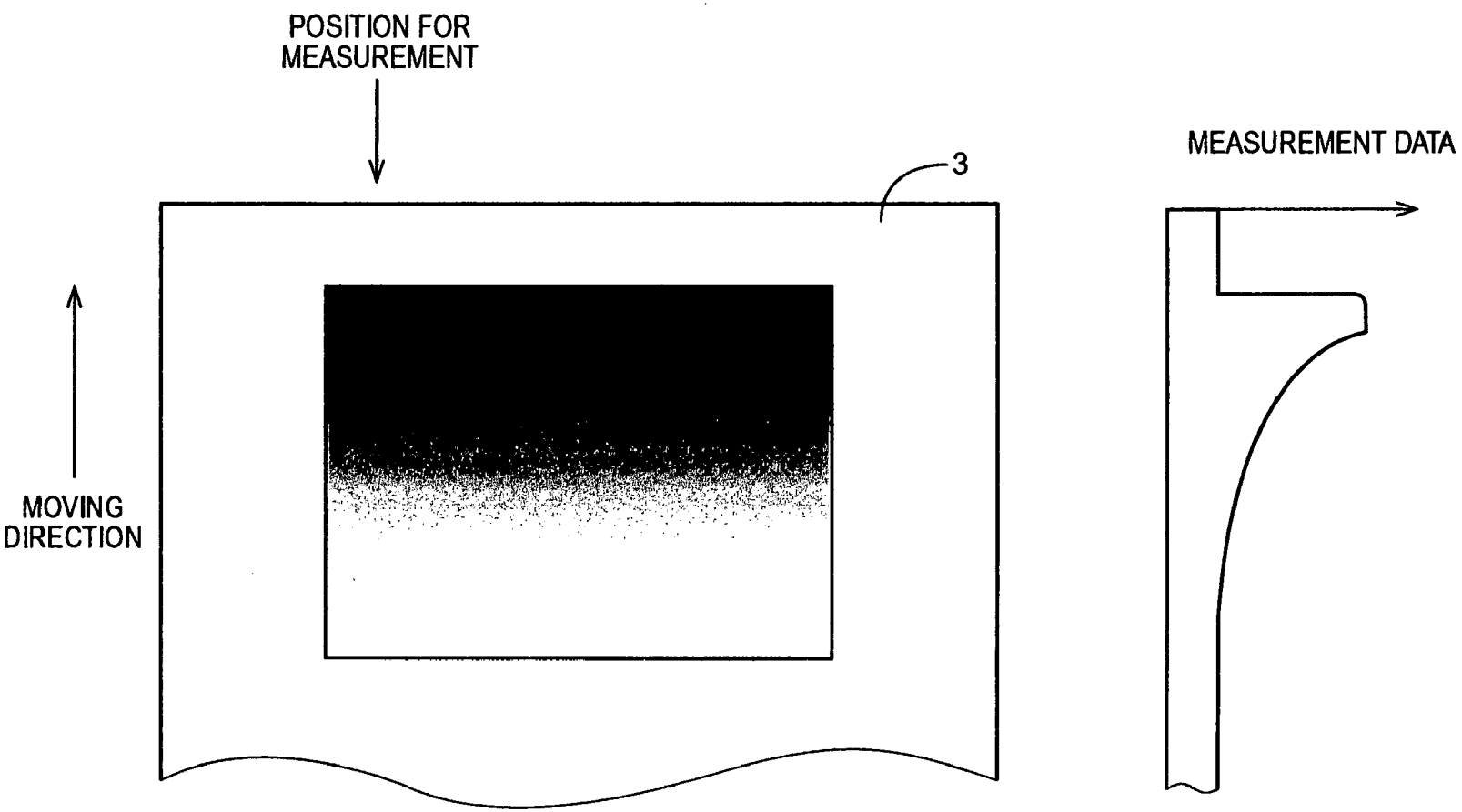
FIG. 10 schematically illustrates in view and graph an approach of measuring the density of a particular image, which is performed by the controller 50 shown in FIG. 2.

Further, as shown in top view and graph in FIG. 10, a predefined image having gradations of color is formed as a second test image, and is then measured with respect to the density of the formed image by means of the density sensor 43 (alternatively or additionally, by means of at least one of the density sensors 40, 41, and 42 on a per primary color basis.

In the image formation processing for measurement, position data representative of the measurement results of the position of the formed first-test-image, and density data representative of the measurement results of the density of the formed second-test-image each constitute the aforementioned measurement data. The measurement data is stored in the internal memory 50*g* and/or the external memory 90 in association with the aforementioned environmental parameters currently obtained.

Upon implementation of the image formation processing for measurement in the step S30, the program proceeds to a step S40. The step S40 is implemented to capture from the management table the measurement data (the position data and the density data) which has been produced as a result of the implementation of the step S30. The step S40 is further implemented to calculate the correction values (absolute values) for the position-related and for the density-related conditions. Thus, the step S40 is assigned for implementing the position correction and the density correction both described above.

More specifically, in the step S40, the correction value of the position-related condition is calculated, for correction of the image formation conditions that were employed in forming the test image for obtaining the corresponding measurement data, such that the position of the subsequently-formed image will become closer to the desired position, based on the difference between an image-formed position (i.e., the position of an image formed on an image-formed medium, such as the photoconductive belt 22, the intermediate transfer belt 26, and a sheet 3 of paper) represented by the position data of the thus-obtained measurement data, and the desired position. The above formation of the test image was performed not for obtaining a printed matter, but for merely measuring the image-formed position.

Similarly, in the step S40, the correction value of the density-related condition is calculated, for correction of the image formation conditions that were employed in forming the test image for obtaining the corresponding measurement data, such that the density of the subsequently-formed image will become closer to the desired density, based on the difference between an image-formed density represented by the density data of the thus-obtained measurement data, and the desired density. The above formation of the test image was performed not for obtaining a printed matter, but for merely measuring the image-formed density.

The above step S40 is followed by a step S50 to correct the image formation conditions so as to reflect the thus-calculated correction values of the position-related condition and density-related condition, whereby new image-formation-conditions are created. The newly-created image-formation-conditions are stored in the management table in association with the aforementioned retrieved measurement data. As a result, the correspondence between the user-commanded conditions and the image formation conditions is updated in the management table. The step S50 is followed by a step S60 to call and execute a program for processing for image formation described later.

Although the initiation control program has been described above as to the case in which the determination of the step S20 is negative "NO" because of the fact that only old measurement data that has been stored over the predetermined period of time is present, the program will be described below as to the case in which the determination of the step S20 is affirmative "YES" because of the fact that the measurement data which has been stored within the predetermined storage period is present.

Where the determination of the step S20 is affirmative "YES," the program proceeds to the step S40 to capture from the management table the measurement data which has been stored under the predetermined storage period. The step S40 is further implemented to calculate the correction values (absolute values) of the position-related and density-related conditions of the image formation conditions, based on the captured measurement data.

More specifically, in the step S40, the correction value of the position-related condition is calculated, such that the image-formed position which will be achieved as a result of the execution of a first cycle of print job since the power on of the printer 1 will become closer to the desired position, based on the difference between the image-formed position represented by the position data of the captured measurement data, and the desired position of the image. In the step S40, the captured measurement data is handled as data representing a position expected to be approximate to the image-formed position which will be achieved as a result of the execution of the first cycle of print job.

Further, in the step S40, the correction value of the density-related condition is calculated, such that the image-formed density which will be achieved as a result of the execution of the first cycle of print job will become closer to the desired density, based on the difference between the image-formed density represented by the density data of the captured measurement data, and the desired density of the image. In the step S40, the captured measurement data is handled as data representing a density expected to be approximate to the image-formed density which will be achieved as a result of the execution of the first cycle of print job.

The step S50 is followed by a step S60 to call and execute the above program for processing for image formation.

FIG. 5 illustrates schematically in flow chart the program for processing for image formation.

As shown in FIG. 5, the program for processing for image formation is initiated with a step S100 to make a determination as to whether it is in a receiving state in which image data is received via the communication I/F 50*a*. If it is not in the receiving state, the determination of the step S100 becomes negative "NO," the step S100 is repeatedly implemented. On the other hand, if it is in the receiving state, the determination of the step S100 becomes affirmative "YES," a step S105 is implemented to store the received image data into a buffer area assigned to the RAM 50*d*.

The step S105 is followed by a step S110 where a determination is made as to whether 1 sheet's worth (or 1 page's worth) image data has been received. If the reception of 1 sheet's worth image data has not been completed, then the determination of the step S110 becomes negative "NO," and the computer returns to the step S100. On the other hand, the reception of 1 sheet's worth image data has been completed, then the determination of the step S110 becomes affirmative "YES," the computer proceeds to a step S115.

The step S115 is implemented to make a determination as to whether the aforementioned status flag represents "0." If the status flag currently represents "1," then the determination of the step S115 becomes negative "NO," and a step 130 is immediately implemented without implementation of steps S120 and S125 both described later. On the other hand, if the status flag currently represents "0," then the determination of the step S115 becomes affirmative "YES," and the computer proceeds to a step S120.

The step S120 is implemented to retrieve from the management table, at least one of a plurality sets of previously-obtained measurement data which is the closest in value to the current user-commanded conditions. The step S120 is further implemented to calculate the correction value of the image formation conditions correspondingly to the current user-commanded conditions, based on the retrieved measurement data.

The step S120 is followed by a step S125 to correct and set the image formation conditions so as to reflect the thus-calculated correction value.

Now, the reasons for and the approach of correcting the image formation conditions will be more specifically described by way of an example of the correction of the density of an image.

The aforementioned buffer area assigned to the RAM 50*d* has stored therein image data which is to be processed by the computer for performing the coming printings. The image data is defined to include instructive information having first information relating to the "color" and second information relating to the "density" (corresponding to the aforementioned density condition) of an image to be printed.

More specifically, the instructive information indicates to the printer 1, in which color of toner among yellow, magenta, cyan, and black toners, and at what percentage of density (the concentration of toner, i.e., the ratio in number of ones of all the pixels which are covered with toner, to all the pixels) the coming printings are to be performed within a designated area of a sheet 3 of paper as an example of a recording medium. Based on the instructive information, the actual printings will be performed.

However, the change or variation in environment in which the printer 1 is situated (i.e., factors, such as the temperature and the humidity), or the temporal change in quality of the toner used in the printer 1, may cause a disagreement in hue and density between the actual image printed on the sheet 3 so as to follow the instructive information included in the image data, and the desired image represented by the instant instructive information.

Therefore, in order to obtain an accurate printed image which reflects the instructive information more faithfully, a correction is properly made to at least one of the image formation conditions which relates to the print density indicated by the instructive information, whereby the printings are performed under the corrected image-formation-conditions.

In the present embodiment, for the correction of the image formation conditions with respect to the print density, there are recorded, as illustrated fragmentarily in FIG. 8, in the aforementioned management table, per each cycle of previous print job, in association with each other:

the measurement data representing the environmental parameters such as the temperature and the humidity within the printer 1 at the corresponding cycle of print job;

the measurement data representing the position and the density of the formed image which were achieved as a result of the corresponding cycle of print job;

the density condition commanded by the user for the corresponding cycle of print job; and the image formation conditions employed at the corresponding cycle of print job.

As shown in FIG. 8, the "name of measurement data" is entered into the management table per each cycle of print job. In association with the "name of measurement data," the measurement data representing the position and the density of the formed image; the density condition commanded by the user; and the image formation conditions employed for printings are stored in the management table.

In the step S120, in order to correct the image formation conditions with respect to the print density, the environmental parameters, such as the temperature and the humidity within the printer 1 are detected using the aforementioned sensors, prior to execution of the coming printings.

The step S120 is further implemented to retreive from the management table, at least one of a plurality sets of measurement data previously stored in the management table with respect to the print density for previous cycles of printings.

The thus-retrieved measurement data has been stored in the management table in association with both the enviromental parameters identical or substantially the closest in value to the currently detected environmental parameters, and the density condition identical or substantially the closest in vaue to the density condition currently commaneded by the user.

The step S120 is further implemented to calculate the correctin value of the density-related condition (e.g., the development bias) of the image formation conditions, based on the difference between the value of a first density represented by the retreived measurement data, and the value of a second density indicated by the instructive information of the image data to be processed for a coming printing with respect to the density, which is to say, the value of the density indicated by the current density condition commanded by the user.

In this context, the value of the first density means the value of the measured density for a previous printing, and also means the value of the predicted density for a coming printing, while the value of the second density means the commannded density by the user.

The step S120 is followed by a step S125 to store the calculated correction value into the RAM 50*d*, and to correct the density-related condition of the image formation conditions so as to reflect the calculated correction value.

As will be evident from the above description, the steps S120 and S125 correspond to the density correction of the pre-correction described above.

The step S125 is followed by a step S130 to bitmap the received image data on an expansion area assigned to the RAM 50*d*, to thereby expect or estimate a coming whole image that will be printed subsequently. The step S130 is followed by a step S135 to make a determination as to whether the expected or estimated whole image represented by the bitmapped image-data includes a portion suitable for use in correcting the image formation conditions. The portion suitable for correction means a portion of the expected whole image which is suitable for use in measuring the print density or the print position.

A first portion of the expected whole image suitable for use in correcting the image formation conditions with respect to the print position may be embodied as a line image of the expected whole image which extends across the feeding direction of the sheet 3, similarly with the image formation processing for measurement as described above.

Figure 11:
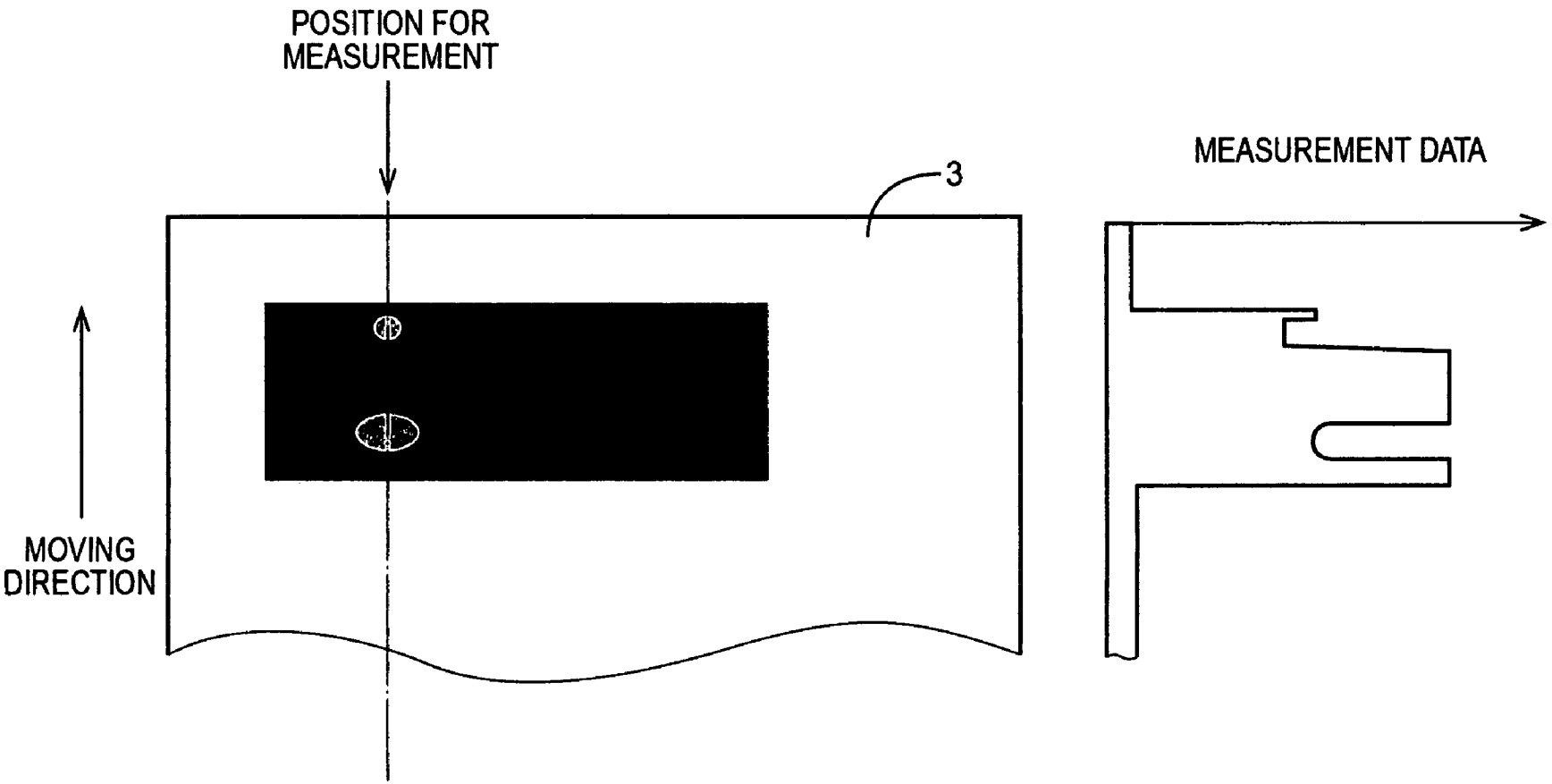
FIG. 11 schematically illustrates in view and graph an approach of measuring the density of a solid area formed on an image-formed medium, by the controller 50 shown in FIG. 2.

A second portion of the expected whole image suitable for use in correcting the image formation conditions with respect to the print density may be embodied as a solid area of the expected whole image which is uniform in density, while not as a solid area of the expected whole image which is not uniform in density as shown in FIG. 11.

If the expected whole image includes at least one of the first and second portions suitable for correction, then the determination of the step S135 becomes affirmative "YES," and a step S140 is implemented for executing by the computer a program for processing for printing and measuring described below.

On the other hand, if the expected whole image does not include the first or the second portion suitable for correction, then the determination of the step S135 becomes negative "NO," a step S145 is implemented to print an image under the image formation conditions set in the step S125.

However, if the status flag represents "0," the image is printed in the step S145 after the steps S120 and S125 are skipped. In this event, the image formation conditions are set depending on the density condition represented by the instructive information of the currently-received image data, using the aforementioned management table uncorrected or a previously-defined separate management table.

The step S145 is followed by a step S150 to make a determination as to whether the status flag represents "0." If the status flag represents "0," then the determination of the step S150 becomes affirmative "YES," and the computer immediately returns to the step S100. On the other hand, if the status flag represents "1," then the determination of the step S150 becomes negative "NO," the computer proceeds to a step S155.

The step S155 is implemented to retrieve from the RAM 50*d* a calculation value. Basically, the calculation value coincides with the correction value calculated in the step S120. However, the calculation value does not always coincide with the calculated correction value. The reasons will be described below.

As described below, where the calculated change amount described above does not exceed the aforementioned allowable range, the image formation conditions are corrected so as to fully reflect the calculated correction value.

On the other hand, where the calculated change amount exceeds the allowable range, the image formation conditions are corrected so as to partially reflect the calculated correction value within the allowable range. In this case, the calculated correction value is updated in the RAM 50*d* as a result of the subtraction of a portion of the original correction value which has been reflected in the corrected image-formation-conditions.

The step S155 is followed by a step S160 to calculate the difference between the calculation value retrieved in the step S155, and the current value (absolute value) of at least one of the image formation conditions as the aforementioned change amount (relative value). The step S160 is further implemented to make a determination as to whether the calculated change amount falls within the allowable range. The allowable range is defined to prevent the user from distinctly noticing the difference between successive images even at the user's glance thereat.

If the calculated change amount does not fall within the allowable range, then the determination of the step S160 becomes negative "NO," and a step S165 is implemented to make a determination as to whether one cycle of print job has been completed, wherein the print job is commanded from a peripheral (e.g., a computer externally linked with the printer 1) allowing an entry of image data into the printer 1. If one cycle of print job has not been completed, then the determination of the step S165 becomes negative "NO," and the computer proceeds to a step S170.

The step S170 is implemented to set the image formation conditions in preparation for the subsequent cycle of print job, so as to reflect partially the calculated change amount within the allowable range, resulting in the correction of the image formation conditions with respect to the print density. A portion of the calculated change amount which exceeds the allowable range will be reflected in the image formation conditions for a separated cycle of print job following the above subsequent cycle of print job, for example. The step S170 is further implemented to store the corrected image-formation-conditions into a setting buffer for density control, for example.

The step S170 is followed by a step S175 to set the status flag to "1," and the computer returns to the step S100.

Where the determination of the step S160 is affirmative "YES" because of the fact that the calculated change amount of the image formation conditions falls within the allowable range, or where the determination of the step S165 is affirmative "YES" because of the fact that a print job commanded from the aforementioned peripheral, or an external device for allowing an entry of image data into the printer 1 has been completed, a step S180 is implemented to correct the density-related condition of the image formation conditions so as to fully reflect the above calculation value and to set the corrected image-formation-conditions as new image-formation-conditions. The step S180 is followed by a step S185 to set the status flag to "0," and the computer returns to the step S100.

FIG. 6 illustrates schematically in flow chart the aforementioned program for processing for printing and measuring.

As shown in FIG. 6, the program is initiated with a step S200 to print an image and to obtain measurement data delivered from the density sensor 43. The step S200 is followed by a step S205 to store the obtained measurement data into the internal memory 50*g* and/or the external memory 90. As a result of the implementation of the step S205, The measurement data is stored into these memories in association with the environmental parameters including: the date and the time of the day that the measurement was performed; the temperature and the humidity within the printer 1; the print mode; the type of the sheet 3; etc.

The step S205 is followed by a step S210 to make a determination as to whether the obtained measurement data includes position data suitable for use in correcting the position-related condition of the image formation conditions. If the current measurement data does not include such position data, then the determination of the step S210 becomes negative "NO," and the computer immediately proceeds to a step S225 as described below.

On the other hand, the current measurement data includes such position data, then the determination of the step S210 becomes affirmative "YES," and the computer proceeds to a step S215. The step S215 is implemented to calculate the correction value of the position-related condition based on the current measurement data. The step S215 is followed by a step S220 to set the corrected position-related condition as a new position-related condition.

In any event, the step S225 is implemented to make a determination as to whether the current measurement data includes density data suitable for use in correcting the density-related condition of the image formation conditions. If the current measurement data does not include such density data, then the determination of the step S225 becomes negative "NO," and the computer proceeds to a step S230.

The step S230 is implemented to make a determination as to whether the status flag represents "0." If the status flag represents "0," the determination of the step S230 becomes affirmative "YES," and one cycle of the execution of the program is terminated. On the other hand, if the status flag represents "1," then the determination of the step S230 becomes negative "NO," and the computer proceeds to a step S240 as described below.

On the other hand, if the current measurement data includes the density data suitable for use in correcting the density-related condition, then the determination of the step S225 becomes affirmative "YES," and a step S235 is implemented to calculate the correction value of the density-related condition based on the current measurement data.

The step S235 is followed by the step S240 to calculate the change amount of the calculated correction value from the current value of the density-related condition. The step S240 is further implemented to make a determination as to whether the calculated change amount falls within the aforementioned allowable range.

It is added that, where the steps S215 and S220 are skipped because of the determination of the step S210 being negative "NO," the step S235 is implemented to retrieve the aforementioned calculation value from the RAM 50*d*, and to calculate the change amount of the retrieved calculation value from the current value of the density-related condition.

In any event, if the change amount falls within the allowable range, then the determination of the step S240 becomes affirmative "YES," and the computer proceeds to a step S245.

The step S245 is implemented to correct the density-related condition to fully reflect the calculated correction value, and to set the corrected density-related condition as a new density-related condition. The step S245 is followed by a step S250 to set the status flag to "0," leading to a termination of one cycle of the execution of the program.

On the other hand, if the change amount does not fall within the allowable range, then the determination of the step S240 becomes negative "NO," and the computer proceeds to a step S255. The step S255 is implemented to make a determination as to whether the current cycle of print job commanded from the aforementioned peripheral has been completed. If so, after the steps S245 and S250 are implemented as described above, one cycle of the execution of the program is terminated.

On the other hand, if the current cycle of print job has not been completed, the determination of the step S255 becomes negative "NO," and the computer proceeds to a step S260.

The step S260 is implemented to correct the density-related condition within the allowable range, and to set the corrected density-related condition as a new density-related condition.

The step S260 is followed by a step S265 to set the status flag to "1,' and one cycle of the execution of the program is terminated.

As will be readily understood from the above description, the printer 1 is operated, such that a determination is made as to whether image data externally entered includes the position data suitable for use in correcting the position-related condition and the density data suitable for use in correcting the density-related condition.

Where the image data includes the position data and the density data suitable for correction, the image-formed position and the image-formed density are measured, and the measurements are used to correct the position-related condition and the density-related condition, and the corrected position-related and density-related conditions are set as new position-related and density-related conditions, respectively.

That is, the printer 1 constructed according to the present embodiment is configured, where the user enters into the printer 1 image data representative of an image that the user wishes to be formed on the sheet 3 of paper to obtain a printed matter, so as to newly set the image formation conditions based on the image-formed position and the image-formed density of the image formed on the sheet 3 of paper by the image forming section 5.

Therefore, the printer 1 allows an optimization of an image formation without requiring a formation of an extra test-pattern, unlike in a conventional printer.

Further, the printer 1 is operated, such that the image-formed position and the image-formed density are measured on a per primary color basis, and, based on the measurements, the position-related condition and the density-related condition are corrected on a per primary color basis. The corrected position-related and density-related conditions are set as new position-related and density-related conditions.

Still further, the printer 1 may be operated, such that the image-formed position and the image-formed density are measured on a per primary color basis, and, based on not only the measurement results which are currently obtained, but also the measurement results which were previously obtained, the position-related condition and density-related condition are corrected on a per primary color basis using a suitable statistical approach, for example. In this case, the previously obtained measurement results are measurement data which has been stored within the internal memory 50*g* and/or external memory 90 within a predetermined storage period of time (one week, for example).

Therefore, the printer 1 facilitates a formation of a multi-color image without shift in color and density.

Still further, the printer 1 constructed according to the present embodiment is configured to utilize position data representative of the image-formed position of the line image for setting the position-related condition.

Therefore, the printer 1 makes it more easily and more accurately to capture or detect a shift in the image-formed position, than when utilizing position data representative of a separate figure such as a curved segment. Eventually, it results in an easy and accurate setting of the position-related condition.

Yet further, the printer 1 constructed according to the present embodiment is configured to set the position-related and density-related conditions per each cycle of image formation. Therefore, the printer 1 allows, where a previous cycle of image formation was performed with a shift in position and density, a subsequent cycle of image formation to be performed with a corrected or reduced shift.

Further, the printer 1 constructed according to the present embodiment is configured to correct the density-related condition within the allowable range for setting the density-related condition, so as not to fully reflect the calculated correction value, where the calculated change amount of the calculated correction value from the current value of the density-related condition exceeds the allowable range.

Therefore, the printer 1 prevents the density of an image from being distinctly varied between a previous-formed image and a subsequently-formed image.

Still further, the printer 1 constructed according to the present embodiment is configured to measure the environmental parameters, such as the date and the time of the day that the measurement data representative of the density and the position was obtained, the temperature and the humidity within the body casing 2 of the printer 1 at the measurement, etc., and to store the obtained measurement data in the internal memory 50*g* and the external memory 90 in association with the measured environmental parameters.

Therefore, the printer 1 allows an optimization of an image formation in conformity with the environment in which the printer 1 is situated, provided that the measurement data and the environmental parameters are together stored in association with each other.

Further, the printer 1 constructed according to the present embodiment is configured to use the external memory 90 of a removable type. Therefore, a mere attachment of the external memory 90 to the printer 1 enables the printer 1 to form an image in an appropriate manner.

In addition, the same external memory 90 can be shared with the printer 1 and a plurality of separate printers compatible to the printer 1. In this case, the measurement data originally obtained in one of these printers can be employed in a separate one of these printers, such that the separate one reflects the original measurement data in forming an image, allowing the separate one to perform an optimized image-formation.

As will be evident from the above description, in the present embodiment, the scanning device 10, the processing device 11, the transfer device 12, the fusing device 14, and the controller 50 together constitute one example of the "image-forming device" set forth in mode (1), and the density sensors 40–43 each constitute one example of the "measuring device" set forth in the same mode. The density sensor 43 functions to measure the density of an image formed on the sheet 3 of paper which is one example of the "recording medium "set forth in mode (28).

Further, in the present embodiment, the internal memory 50*g* and the external memory 90 each constitute one example of the "storage medium" set forth in mode (1), and a portion of the controller 50 which is assigned to implement the steps S40 and S50 show in FIG. 4, the steps S120, S125, and S180 shown in FIG. 5, and the steps S215, S220, S235, and S245 shown in FIG. 6 constitutes one example of the "setting device" set forth in the same mode.

Still further, in the present embodiment, a portion of the controller 50 which is assigned to implement the steps S40 and S50 shown in FIG. 4, and the steps S215 and S220 shown in FIG. 6 constitutes one example of the "position-related-condition setting subsystem" set forth in mode (9), and a portion of the controller 50 which is assigned to implement the steps S120, S125, and S180 shown in FIG. 5, and the steps S235, S245, and S260 shown in FIG. 6 constitutes one example of the "picture-property-related-condition setting subsystem" set forth in mode (14).

Although the present invention has been described above with respect to one embodiment thereof, it does not mean that the present invention is limited to the present embodiment in practice. The present invention may be practiced with various modifications or improvements to the present embodiment without departing from the scope and spirit of the present invention.

For example, while the printer 1 according to the present embodiment shown in FIG. 1 is a color laser printer of a four-cycle type, the printer 1 may be replaced with a color laser printer of a tandem type.

In general, the tandem-type color laser printer is configured to incorporate individual exposure units for respective individual primary colors, differently from the four-cycle-type color laser printer utilizing a single exposure unit in common to all the primary colors.

As a result, the use of the tandem-type color laser printer causes shifts in the image-formed position, not only due to variations in rotational speed at a roller for driving a photoconductive belt and an intermediate transfer belt, and a roller for transporting a sheet of paper, but also due to error in position of the respective individual exposure units.

Therefore, where the present invention is practiced in the tandem-type color laser printer, the measurements of the positions of not only a line segment of an image extending across the moving direction of the photoconductive belt, the intermediate transfer belt, or the sheet of paper, but also an additional line segment of the same image extending along the moving direction allows an accurate capture of the amount of shift in position per direction, resulting in an optimized correction of the position-related condition.

Figure 7:
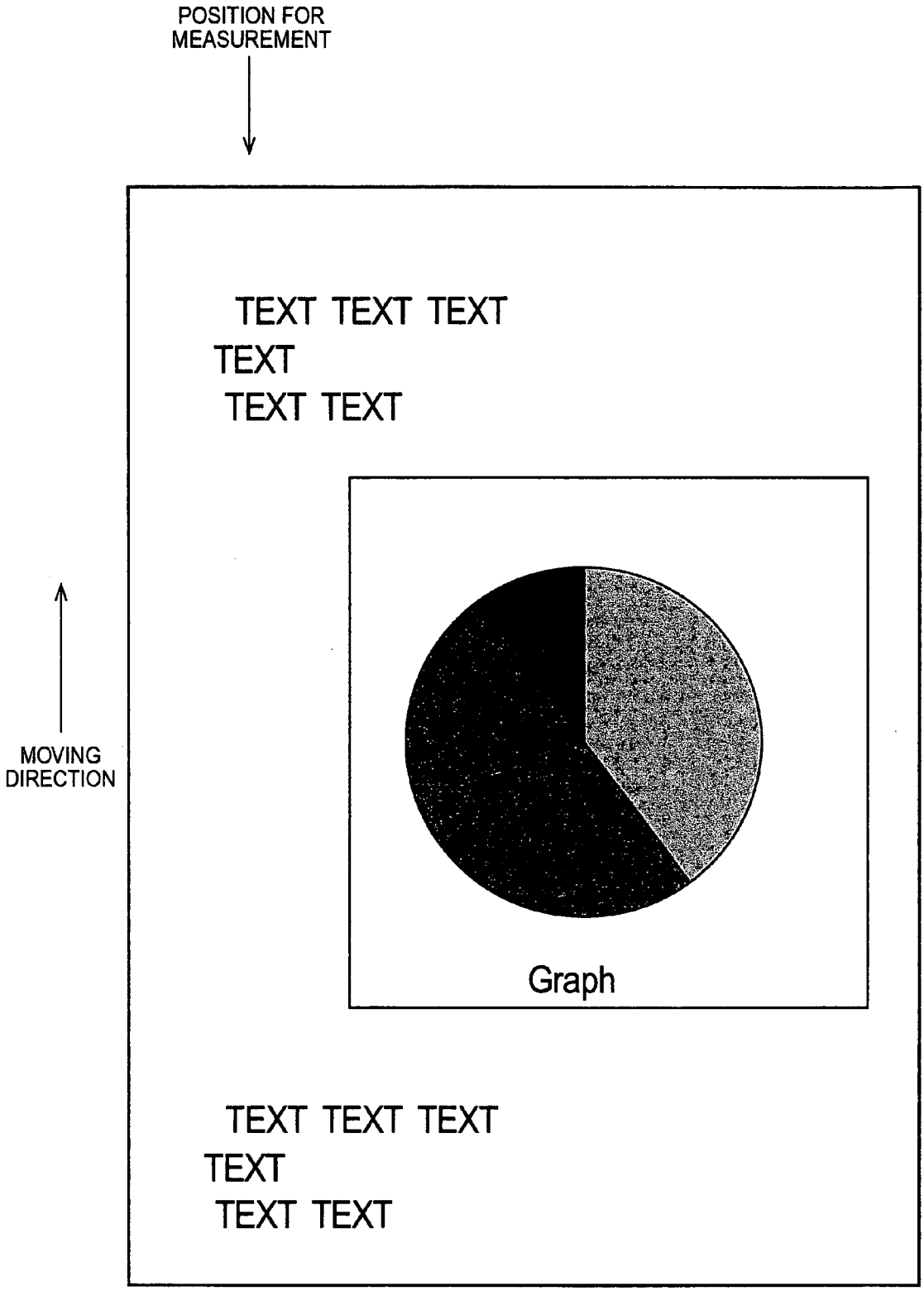
FIG. 7 is a view for explaining a position at which measurements using density sensors 40–43 shown in FIG. 2 are performed.

There may be utilized for measuring the image-formed position, a density sensor that measures the density of an image formed on a recording medium such as a sheet of paper along the moving direction at a fixed lateral position, like the density sensors 40 to 43 in the first embodiment as shown in FIG. 7. The fixed lateral position may be located as a measuring position of the density sensor, in the vicinity of one lateral edge of the recording medium, or the vicinity of the center of the width of the recording medium.

However, such a line segment extending along the moving direction is not always passed through the above measuring position of the density sensor.

To eliminate disadvantages due to the above, there may be utilized for measuring the image-formed position, instead of a combination of a first line segment extending perpendicular to the moving direction of the recording medium and a second line segment extending parallel to the moving direction, two line segments which both intersect diagonally the moving direction so as to be different from each other in angle to the moving direction.

The measurements of the positions of the two line segments obtained using the density sensor reflect the same lateral shift in position of the recording medium differently from each other. Therefore, the measurements can estimate not only the amount, but also the direction, of an unexpected shift in position of an image formed.

These two line segments may be symmetric with respect to a line extending perpendicular to the moving direction. These two line segments may be connected with each other or may be disconnected.

While the present embodiment shown in FIG. 8 is configured such that, measurement data, once obtained, is stored in the internal memory 50*g* and the external memory 90 in a non-overwrite manner, the present invention may be practiced so as to store successive sets of measurement data in an overwrite manner.

The present embodiment shown in FIG. 8 is practiced such that the density-related condition is corrected for avoiding a distinctive variation in density within each cycle of print job in a manner that the change amount of the density-related condition does not exceed the allowable limit per each cycle of print job. Alternatively, the regulation of density-related condition may be performed such that the change amount of the density-related condition does not exceed the allowable limit per each cycle of print, for avoiding a distinctive variation in density within each cycle of print.

Next, there will be described a second embodiment of the present invention. The present embodiment, as compared with the first embodiment described previously, differs in that a program for correcting the density-related condition is added to the elements common to those of the printer 1 according to the first embodiment.

Therefore, for better understanding the present embodiment, only the program for correcting the density-related condition will be described and illustrated, while the common elements will be denoted by the same reference numerals or names as the corresponding elements in the first embodiment for avoiding a redundant description or illustration.

Figure 13:
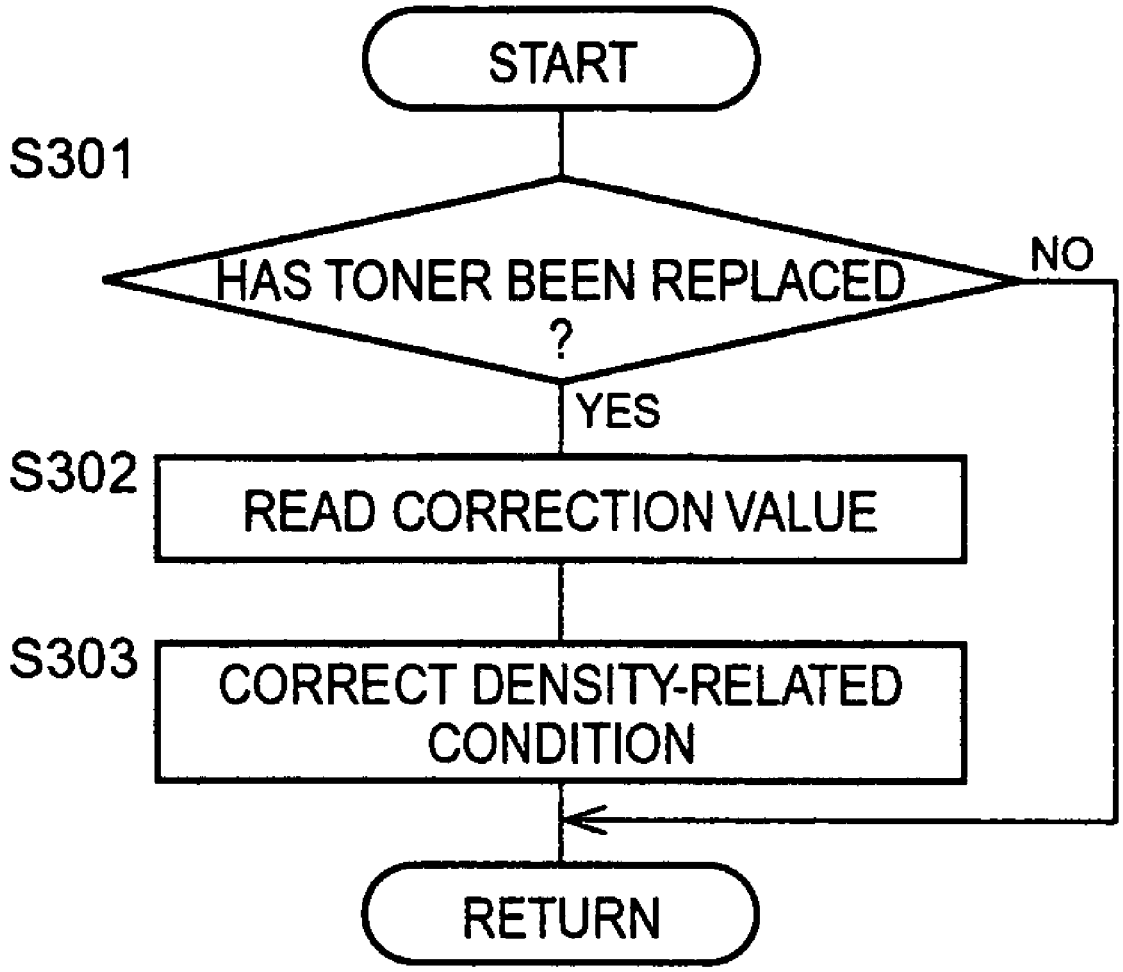
FIG. 13 is a flow chart schematically illustrating a program for correcting a density-related condition in a printer constructed according to a second embodiment of the present invention.

FIG. 13 schematically illustrates in flow chart the aforementioned program for correcting the density-related condition to be executed by the computer of the controller 50 within the printer 1 according to the present embodiment.

The program for correcting the density-related condition is repeatedly executed. Each cycle of the execution of the program begins with a step S301 to make a determination as to whether each of the toner storages (hereinafter, also referred to simply as "toner") within the printer 1 has been replaced to be replenished with fresh toner, by the use of a corresponding toner replacement sensor as not shown. If none of the toner storages has been replaced, then the determination of the step S301 becomes negative 'NO,' resulting in an immediate termination of one cycle of the execution of the program for correcting the density-related condition.

On the other hand, if the toner replacement sensor has detected the replacement of the corresponding toner storage, then the determination of the step S301 becomes affirmative "YES," and a step S302 is implemented to retrieve a correction value of the density-related condition from the ROM 50*c*. The correction value has been previously set and stored in the ROM 50*c* so as to represent a value into which the density-related condition is required to be corrected in preparation for the use of new toner.

The step S302 is followed by a step S303 to correct the density-related condition so as to reflect the thus-retrieved correction value, and to cause the printer 1 to print under the corrected density-related condition. Then, one cycle of the execution of the program for correcting the density-related condition is terminated.

Therefore, the present embodiment allows an image formation at the density in conformity with new toner since a point of time immediately after the replacement of toner.

As will be readily understood from the above description, in the present embodiment, the toner for each primary color constitutes one example of the "colorant" set forth in mode (21), and a portion of the controller 50 which is assigned to execute the program for correcting the density-related condition constitutes one example of the "correcting subsystem" set forth in the same mode.

Next, there will be described a third embodiment of the present invention. The present embodiment, as compared with the first embodiment described previously, differs in that a program for correcting the density-related condition is added to the elements common to those of the printer 1 according to the first embodiment.

Therefore, for better understanding the present embodiment, only the program for correcting the density-related condition will be described and illustrated, while the common elements will be denoted by the same reference numerals or names as the corresponding elements in the first embodiment for avoiding a redundant description or illustration.

Figure 14:
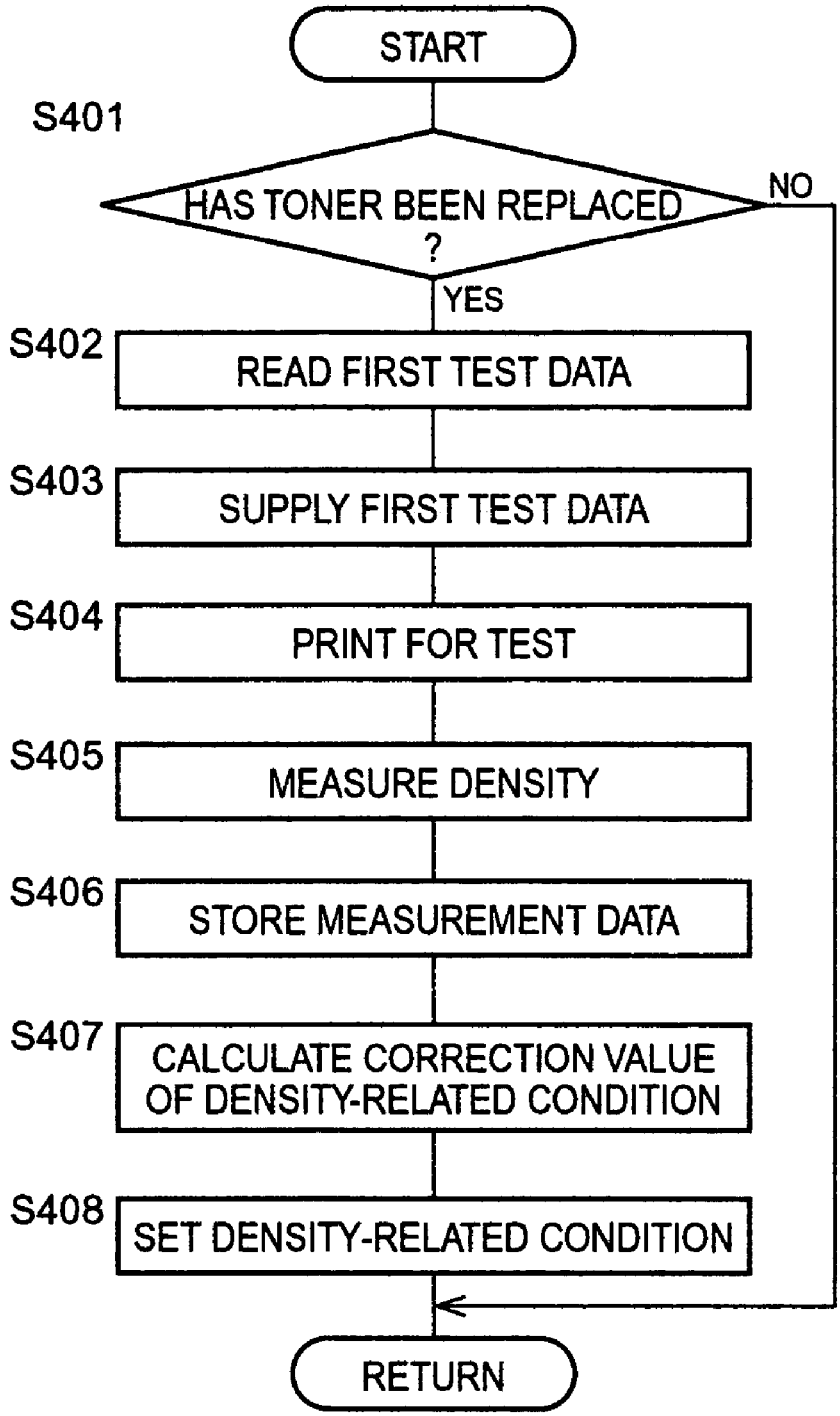
FIG. 14 is a flow chart schematically illustrating a program for correcting a density-related condition in a printer constructed according to a third embodiment of the present invention.

FIG. 14 schematically illustrates in flow chart the aforementioned program for correcting the density-related condition to be executed by the computer of the controller 50 within the printer 1 according to the present embodiment.

The program for correcting the density-related condition is repeatedly executed. Each cycle of the execution of the program begins with a step S401 to make a determination as to whether each of the toner storages (hereinafter, also referred to simply as "toner") within the printer 1 has been replaced to be replenished with fresh toner, by the use of a corresponding toner replacement sensor as not shown. If none of the toner storages has been replaced, then the determination of the step S401 becomes negative 'NO,' resulting in an immediate termination of one cycle of the execution of the program for correcting the density-related condition.

On the other hand, if the toner replacement sensor has detected the replacement of the corresponding toner storage, then the determination of the step S401 becomes affirmative "YES," and a step S402 is implemented to retrieve from the ROM 50*c*, first test-data required for forming a first test-image. The first test-image is for use in measuring the print density, i.e., the image-formed density.

The step S402 is followed by a step S403 to deliver the retrieved first test-data to the CPU 50*b*. The step S403 is followed by a step S404 to cause the printer 1 to perform a printing for test, based on the delivered first test-data, resulting in a formation of the first test image.

The step S404 is followed by a step S405 to measure the density of the first test-image by means of at least one of the aforementioned density sensors 40–43. The step S405 is followed by a step S406 to store the measurement data (the density data) representative of the measurement result of the first test-image obtained using a corresponding one of the density sensors 40–43, into the management table, in the same manner as used in the first embodiment.

The step S406 is followed by a step S407 to calculate a correction value of the density-related condition based on the above measurement data, in the same manner as performed in the step S40 shown in FIG. 4. The step S407 is followed by a step S408 to correct the density-related condition so as to reflect the calculated correction value, whereby a new density-related condition is created in the same manner as performed in the step S50 shown in FIG. 4. Then, one cycle of the execution of the program for correcting the density-related condition is terminated.

Therefore, the present embodiment allows a more accurate correction of the density-related condition depending on variations in quality of actual individual product of new toner.

As will be readily understood from the above description, in the present embodiment, the toner for each primary color constitutes one example of the "colorant" set forth in mode (22), and a portion of the controller 50 which is assigned to execute the program for correcting the density-related condition constitutes one example of the "first delivery subsystem" set forth in the same mode.

Next, there will be described a fourth embodiment of the present invention. The present embodiment, as compared with the first embodiment described previously, differs in that a program for correcting the image formation conditions is added to the elements common to those of the printer 1 according to the first embodiment.

Therefore, for better understanding the present embodiment, only the program for correcting the image formation conditions will be described and illustrated, while the common elements will be denoted by the same reference numerals or names as the corresponding elements in the first embodiment for avoiding a redundant description or illustration.

Figure 15:
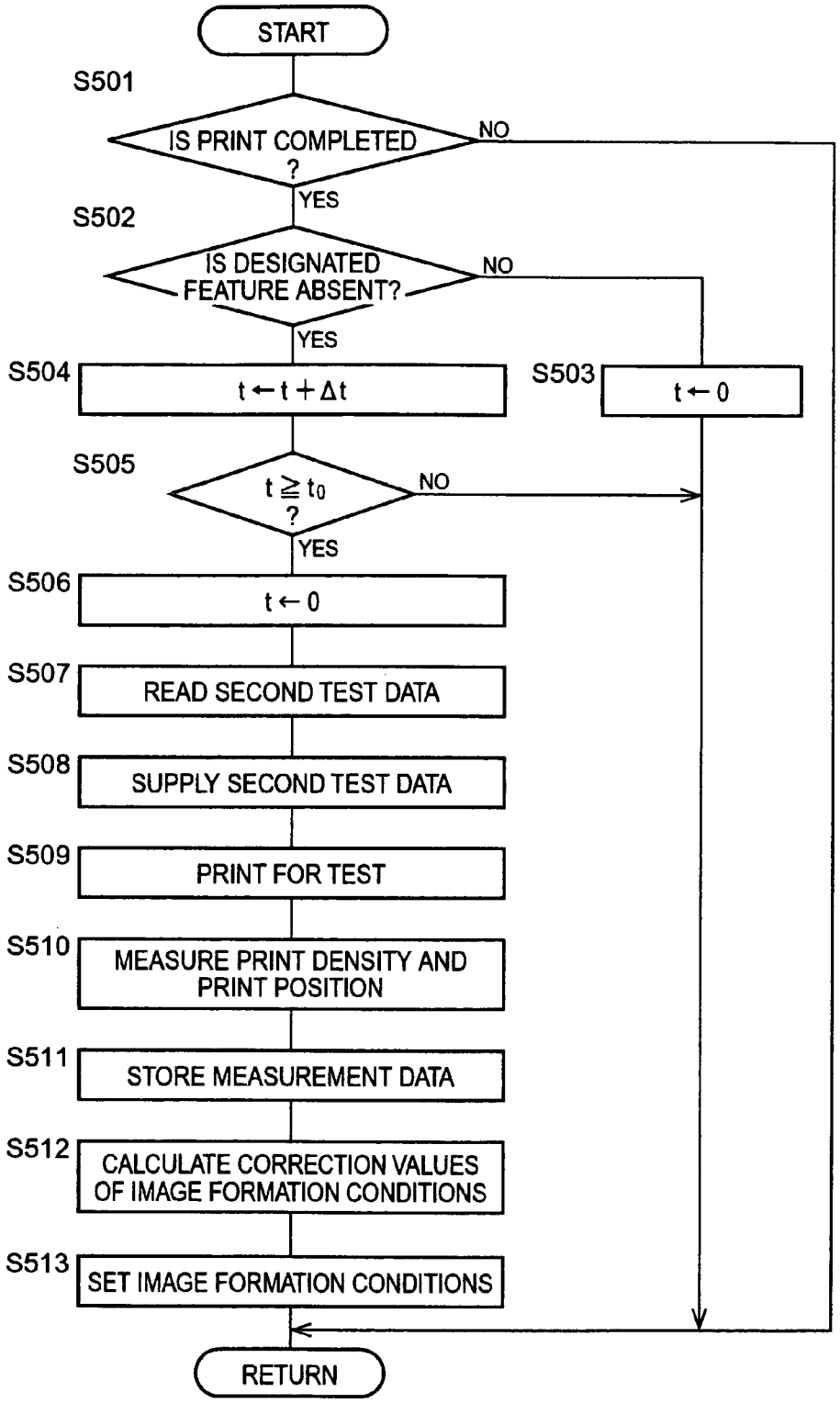
FIG. 15 is a flow chart schematically illustrating a program for correcting image formation conditions in a printer constructed according to a fourth embodiment of the present invention.

FIG. 15 schematically illustrates in flow chart the aforementioned program for correcting the image formation conditions to be executed by the computer of the controller 50 within the printer 1 according to the present embodiment.

The program for correcting the image formation conditions is repeatedly executed. Each cycle of the execution of the program begins with a step S501 to make a determination as to whether one cycle of printing per page or print job has been completed. If not, the determination of the step S501 becomes negative "NO," resulting in an immediate termination of one cycle of the execution of the program.

On the other hand, if one cycle of printing per page or print job has been completed, then the determination of the step S501 becomes affirmative "YES," and a step S502 is implemented to make a determination as to whether a designated feature (for example, a solid image area having a given size, a line image extending in a given direction, etc.) is absent from the image formed as a result of the just-completed one cycle of printing per page or print job.

If the formed image includes the designated feature, then the determination of the step S502 becomes negative "NO," the computer proceeds to a step S503 to set to zero "0" a timer "t" indicative of the length of time elapsed. Upon execution of the step S503, one cycle of the execution of the program for correcting the image formation conditions is terminated. On the other hand, if the formed image does not include the designated feature, then the determination of the step S502 becomes affirmative "YES," and a step S504 is implemented to increase the timer "t" by a given increment Δt.

The step S504 is followed by a step S505 to make a determination as to whether the current value of the timer "t" is not less than a threshold value "t0." If the current value of the timer "t" is smaller than the threshold value "t0," the determination of the step S505 becomes affirmative "NO," and then one cycle of the execution of the program for correcting the image formation conditions is immediately terminated.

On the other hand, if the current value of the timer "t" not less than the threshold value "t0," the determination of the step S505 becomes affirmative "YES," and the computer proceeds to a step S506.

The step S506 is implemented to set the timer "t" to zero "0," and the computer proceeds to a step S507 to retrieve from the ROM 50*c* second test-data for use in forming a second test-image. The second test-image is a preset image which is suitable for use in measuring the print density and the print position of an image formed.

The step S507 is followed by a step S508 to deliver the retrieved second test-data to the CPU 50*b*. The step S508 is followed by a step S509 to cause the printer 1 to print based on the delivered second test-data, resulting in a formation of the second test-image.

The step S509 is followed by a step S510 to measure using at least one of the aforementioned density sensors 40 to 43 the print density and the print position of the second test-image formed. The step S510 is followed by a step S511 to store the measurement data (the density data and the position data) representative of the measurement results of the second test-image obtained using a corresponding one of the density sensors 40–43, into the management table, in the same manner as used in the first embodiment.

The step S511 is followed by a step S512 to calculate correction values of the image formation conditions including the density-related condition and the position-related condition, based on the above measurement data, in the same manner as performed in the step S40 shown in FIG. 4. The correction values include a correction value of the density-related condition, and a correction value of the position-related condition.

The step S512 is followed by a step S513 to correct the image formation conditions so as to reflect the calculated correction values, whereby new image formation conditions are created in the same manner as performed in the step S50 shown in FIG. 4. Then, one cycle of the execution of the program for correcting the image formation conditions is terminated.

As will be readily understood from the above description, in the present embodiment, where a predetermined condition (e.g., a temporal condition monitored using the timer "t") is met while there has not been formed such a regular image that includes a visual or geometrical feature (e.g., the line segment, the solid image area having a size not smaller than the given size) suitable for use in correcting the image formation conditions, there is formed the second test-image including the designated feature, which functions as an extra and not regular image. Using the formed second test-image, the image formation conditions are corrected.

Therefore, the present embodiment allows proper settings of the image formation conditions, even where an image formation has not been suspended for a give time, and where, nevertheless, all the images which have been formed do not each include a graphical feature required for use in correcting the image formation conditions.

In the present embodiment, the second test-data is preferably delivered to the CPU 50*b* only where it becomes necessary to form a special and extra image for measurement. This arrangement avoids the special and extra images for measurement from being unnecessarily formed.

In the present embodiment, the formation of image for measurement and the correction using the formed image for measurement are allowed, provided that a temporal condition has been fulfilled which is defined to be fulfilled when there has reached a reference value (the threshold value "t0," for example), the length of a period of time during which images not including a feature for use in setting the image formation conditions have been continuously formed.

Alternatively, the formation of image for measurement and the correction using the formed image for measurement may be allowed, provided that an alternative condition, i.e., a condition which is defined to be fulfilled when the number of the continuous pages of images formed so as not to include the above feature has reached a reference value, or the number of the continuous printings or print jobs performed so as not to form an image including the above feature, for example.

As will be readily understood from the above description, in the present embodiment, a portion of the controller 50 which is assigned to execute the program for correcting the image formation conditions constitutes one example of the "first delivery subsystem" set forth in mode (25), and the relationship between the threshold value t0 and the length of period of time during which images not each including a feature for use in correcting the image formation conditions have been continuously formed constitutes one example of the "predetermined condition" set forth in the same mode.

While several embodiments of the present invention have been described above, such description is for illustrative purposes, and the present invention may be carried out in alternative embodiments in which various modifications or improvements may be made.

For example, in each of the several embodiments described above, the printer 1 is configured to automatically correct the print density and the print position.

Alternatively or additionally, an arrangement may be adapted in the printer 1 allowing a correction of the hue and the gloss of a printed image, or allowing a correction of the haze (the transparency) of a printed image on a transparent recording medium such as a sheet for an overhead projector (OHP).

When the above arrangement is adapted, the hue, the gloss, or the haze can be measured by means of the density sensor 43. The correction of the gloss and the haze can be made by varying a set value of temperature of the heat roller 27. The correction of the density and the hue can be made by varying the voltage bias applied to the voltage application circuit 70. Alternatively or additionally, the correction of the density and the hue can be made by varying the exposure power, the exposure time, the pulse width for exposure, and a print pattern such as the dither pattern.

In each of the several embodiments described above, the external memory 90 is configured to be removable from the printer 1. Alternatively, the external memory 90 may be configured to be integrally fitted with a corresponding one of the toner storages of the developer unit 15.

In addition, in each of the several embodiments described above, the printer 1 is configured to employ polymeric toner for printing. Alternatively, the printer 1 may be configured to employ pulverized toner for printing.

In each of the several embodiments described above, the density sensors 40–43 are each configured to measure the density of an image at a position located in the vicinity of one lateral end of a corresponding one of the photoconductive belt 22, the intermediate transfer belt 26, and the sheet 3 of paper.

Alternatively, the density sensors 40–43 may be each configured to measure the density of an image at a position located in the vicinity of the center of the width of a corresponding one of the photoconductive belt 22, the intermediate transfer belt 26, and the sheet 3 of paper.

In each of the several embodiments described above, the density sensors 40–43 are each configured to measure the density of a developer image formed on a corresponding one of the photoconductive belt 22, the intermediate transfer belt 26, and the sheet 3 of paper, at a laterally local portion thereof.

Alternatively, the density sensors 40–43 may be each configured to measure the density of a developer image formed on a corresponding one of the photoconductive belt 22, the intermediate transfer belt 26, and the sheet 3 of paper, over the entire width thereof.

Although, in each of the several embodiments described above, the present invention is applied in a color laser printer, the present invention may be applied in a monochrome laser printer.

Where an inkjet printer, whether be of a multi-color type or a monochrome type, is used, water evaporates with time from ink for use in image formation, resulting in increase in viscosity and density of the ink. For this reason, there arises a necessity to form a test patch as with a laser printer. Therefore, the present invention may be applied in an inkjet printer.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An apparatus for forming an image, comprising:

an image-forming device that forms an image on an image-formed medium under an image formation condition, based on image data;

a measuring device that measures a feature of the image formed on the image-formed medium by the image-forming device based on the image data externally entered, to thereby obtain measurement results which are stored in a storage medium; and a setting device that retrieves from the storage medium as a reference measurement-result at least one of the measurement results which conforms to image data representative of a new image to be formed, and that sets the image formation condition for the image data representative of the new image, based on the retrieved reference measurement-result.

2. The apparatus according to claim 1, wherein the setting device retrieves from the storage medium as the reference measurement-result at least one of the measurement results which was obtained by the measuring device for a previous separate image that was formed by the image-forming device in a state substantially the same as a state in which the new image is to be formed by the image-forming device.

3. The apparatus according to claim 1, wherein the setting device sets the image formation condition for the new image to be formed, based on a difference between a desired value of the new image and the retrieved reference measurement-result.

4. The apparatus according to claim 3, wherein the measurement results are stored in the storage medium in association with respective previous values of the image formation condition, wherein the respective previous values were employed by the image-forming device for forming respective previous images from which the respective measurement results were obtained by the measuring device, the setting device calculates a correction value of a corresponding one of the previous values stored in the storage medium, based on the difference; updates content of the storage medium to reflect the calculated correction value, to thereby update a correspondence between desired values of images formed and respective previous values of the image formation condition; and determines a current value of the image formation condition according to the updated correspondence.

5. The apparatus according to claim 1, wherein the image data is commanded by a user of the apparatus to form an image arbitrarily demanded by the user.

6. The apparatus according to claim 1, wherein a new measurement result, once obtained by the measuring device, is stored in the storage medium with replacement of a separate measurement result previously stored therein with the new measurement result.

7. The apparatus according to claim 1, wherein a new measurement result, once obtained by the measuring device, is stored in the storage medium with separate measurement results previously stored therein, without replacement of any one of the separate measurement results with the new measurement result.

8. The apparatus according to claim 1, wherein the measuring device obtains, together with the measurement result, an environmental parameter defining environment in which an image is formed by the image-forming device, wherein the measurement result is stored in the storage medium in association with the obtained environmental parameter, the setting device retrieves from the storage medium, prior to formation of the new image, as the reference measurement-result, at least one of the measurement results which is associated with the environmental parameter substantially coincident with the environmental parameter which was obtained by the measuring device for the new image, and sets the image formation condition based on the retrieved reference measurement-result.

9. The apparatus according to claim 1, wherein the image data and the measurement result each comprise at least position-related information which relates to an image-formed position at which an image is formed on the image-formed medium, the image formation condition comprises a position-related condition which relates to a position at which an image is to be formed on the image-formed medium, the setting device comprises a position-related-condition setting subsystem that sets the position-related condition, based on the position-related information of the image data and the position-related information of the measurement result.

10. The apparatus according to claim 9, wherein the image data comprises at least user-commanded position data specifying an image-formed position commanded by a user of the apparatus, the measurement result comprises at least measured-position data representative of an image-formed position measured by the measuring device, the position-related-condition setting subsystem sets the position-related condition based on a relationship between the user-commanded position data and the measured-position data.

11. The apparatus according to claim 9, wherein the measuring device measures the image-formed position on a per primary color basis.

12. The apparatus according to claim 9, wherein the image comprises a line segment, the position-related-condition setting subsystem employs information specifying a position at which the line segment is formed on the image-formed medium, to thereby set the position-related condition.

13. The apparatus according to claim 9, wherein the position-related-condition setting subsystem sets the position-related condition each the image forming device forms an image or a series of images.

14. The apparatus according to claim 1, wherein the image data and the measurement result each comprise at least picture-property-related information which relates to a picture property defined to include at least one of density, hue, gloss, and haze of the image, the image formation condition comprises a picture-property-related condition which relates to the picture property of an image is to be formed on the image-formed medium, the setting device comprises a picture-property-related-condition setting subsystem that sets the picture-property-related condition, based on the picture-property-related information of the image data and the picture-property-related information of the measurement result.

15. The apparatus according to claim 14, wherein the image data comprises at least user-commanded picture-property data specifying the picture property commanded by the user, the measurement result comprises at least measurement picture-property data representative of the picture property measured by the measuring device, the picture-property-related-condition setting subsystem sets the picture-property-related condition based on a relationship between the user-commanded picture-property data and the measurement picture-property data.

16. The apparatus according to claim 14, wherein the measuring device measures the picture property on a per primary color basis.

17. The apparatus according to claim 14, wherein the measuring device measures the picture property per a measuring area with a predetermined size on the image-formed medium.

18. The apparatus according to claim 14, wherein the picture-property-related-condition setting subsystem sets the picture-property-related condition, each the image forming device forms an image or a series of images.

19. The apparatus according to claim 14, wherein the picture-property-related-condition setting subsystem performs successive settings for a set value of the picture-property-related condition, and makes a change to the set value within a range allowing the set value to be changed per one cycle of the setting.

20. The apparatus according to claim 14, wherein the picture-property-related-condition setting subsystem is operative, each the image forming device executes one cycle of a job for forming an image or a series of images.

21. The apparatus according to claim 14, wherein the image forming device employs colorant for formation of an image, the apparatus further comprising a correcting subsystem that corrects the picture-property-related condition by a predetermined correction amount in response to replacement of the colorant.

22. The apparatus according to claim 1, wherein the image forming device employs colorant for formation of an image, the apparatus further comprising a first delivery subsystem that delivers as the image data first test-data representative of a predetermined first test-image to the image forming device in response to replacement of the colorant, wherein the measuring device measures the feature of the image formed by the image forming device based on the delivered first test-data, to thereby obtain the measurement result.

23. The apparatus according to claim 21, further comprising a detachable container for containing the colorant.

24. The apparatus according to claim 21, wherein the colorant comprises toner or ink.

25. The apparatus according to claim 1, further comprising a second delivery subsystem that delivers to the image forming device, upon satisfaction of a predetermined condition in a state that makes the measuring device incapable to measure a predetermined feature of the image, second test-data representative of a second test-image predefined to incorporate the predetermined feature, wherein the measuring device measures the feature of the image formed by the image forming device based on the delivered second test-data, to thereby obtain the measurement result.

26. The apparatus according to claim 25, further comprising a control subsystem that permits the second delivery subsystem to operate upon demand for formation of the second test-image.

27. The apparatus according to claim 25, wherein the predetermined condition comprises a condition to be satisfied upon elapse of a predetermined period of time.

28. The apparatus according to claim 1, wherein the image-formed medium is formed as a recoding medium.

29. A storage medium set forth in claim 1.

30. The storage medium according to claim 29, wherein the storage medium is detachably attached to the apparatus.

31. A method of forming an image, comprising:

forming an image on an image-formed medium under an image formation condition, based on image data;

measuring a feature of the image formed on the image-formed medium based on the image data externally entered, to thereby obtain measurement results;

storing the obtained measurement results in a storage medium;

retrieving from that storage medium as a reference measurement-result at least one of the measurement results which conforms to image data representative of a new image to be formed; and setting the image formation condition for the image data representative of the new image, based on the retrieved reference measurement-result.

* * * * *